US012543807B2

(12) United States Patent
Zinn

(10) Patent No.: US 12,543,807 B2
(45) Date of Patent: Feb. 10, 2026

(54) GARMENTS, GLOVES AND PERSONAL PROTECTIVE EQUIPMENT ENCHANCED WITH METAL NANOPARTICLE AGGLOMERATES

(71) Applicant: KUPRION INC., San Jose, CA (US)

(72) Inventor: Alfred A. Zinn, Palo Alto, CA (US)

(73) Assignee: Kuprion Inc., Waterbury, CT (US)

( * ) Notice: Subject to any disclaimer, the term of this patent is extended or adjusted under 35 U.S.C. 154(b) by 477 days.

(21) Appl. No.: 17/998,301

(22) PCT Filed: May 21, 2021

(86) PCT No.: PCT/US2021/033526
§ 371 (c)(1),
(2) Date: Nov. 9, 2022

(87) PCT Pub. No.: WO2021/237005
PCT Pub. Date: Nov. 25, 2021

(65) Prior Publication Data

US 2023/0218024 A1 Jul. 13, 2023

Related U.S. Application Data

(60) Provisional application No. 63/028,033, filed on May 21, 2020.

(51) Int. Cl.
*A41D 19/00* (2006.01)

(52) U.S. Cl.
CPC ..... *A41D 19/0006* (2013.01); *A41D 19/0024* (2013.01)

(58) Field of Classification Search
None
See application file for complete search history.

(56) References Cited

U.S. PATENT DOCUMENTS

| | | | |
|---|---|---|---|
| 7,736,414 | B1 | 6/2010 | Zinn |
| 8,105,414 | B2 | 1/2012 | Zinn |
| 8,192,866 | B2 | 6/2012 | Golightly et al. |
| 8,486,305 | B2 | 7/2013 | Zinn et al. |
| 8,834,747 | B2 | 9/2014 | Zinn |
| 9,005,483 | B2 | 4/2015 | Zinn et al. |
| 9,072,185 | B2 | 6/2015 | Zinn |
| 9,095,898 | B2 | 8/2015 | Zinn |
| 9,179,542 | B2 | 11/2015 | Beck et al. |
| 9,700,940 | B2 | 7/2017 | Zinn |
| 2003/0190851 | A1 | 10/2003 | Yan et al. |
| 2011/0047671 | A1 | 3/2011 | Zhu |
| 2016/0201183 | A1 | 7/2016 | Zinn |
| 2017/0252804 | A1 | 9/2017 | Hanni et al. |

FOREIGN PATENT DOCUMENTS

| | | | | |
|---|---|---|---|---|
| CA | 2529236 | A1 * | 6/2006 | ..... A01N 59/16 |
| KR | 200412135 | Y1 | 3/2006 | |
| KR | 20110066402 | A * | 6/2011 | |
| KR | 1020130057280 | A | 5/2013 | |
| WO | 2018183161 | A1 | 10/2018 | |

OTHER PUBLICATIONS

Lee et al., KR-20110066402-A, Jun. 17, 2011 (machine translation) (Year: 2011).*
Written Opinion and International Search Report from corresponding PCT Application No. PCT/US2021/033526 mailed Sep. 15, 2021.

* cited by examiner

*Primary Examiner* — Cheng Yuan Huang
(74) *Attorney, Agent, or Firm* — Carmody Torrance Sandak & Hennessey LLP

(57) ABSTRACT

Metal nanoparticle agglomerates may aid in promoting infection control over an extended period of time when adhered to a touch or contact surface of personal protective equipment, such as gloves or garments. Gloves may comprise a body having one or more touch surfaces when worn, and metal nanoparticle agglomerates adhered to a material defining the one or more touch surfaces. The gloves may further comprise an identifying tag associated with the material. The identifying tag may be electronically identifiable, which may track, for example, how long the gloves have been in use, whether the gloves have been worn, conditions under which the gloves have been worn, and/or locations where the gloves have been worn. Other personal protective equipment and garments may similarly comprise metal nanoparticle agglomerates adhered to at least a portion of a material shaped for wear, optionally including an identifying tag associated with the material.

11 Claims, 7 Drawing Sheets

GARMENTS, GLOVES AND PERSONAL PROTECTIVE EQUIPMENT ENCHANCED WITH METAL NANOPARTICLE AGGLOMERATES

BACKGROUND

The world is facing increasing threats from antibiotic-resistant strains of bacteria (i.e., "super bugs") that cannot be effectively treated due, at least in part, to the overuse of antibiotics. Other types of resistant microorganisms can present similar issues. Increased population densities and efficient mass transit infrastructure have also contributed significantly to both localized and global spread of both common and emerging diseases. Common influenza and emerging viruses such as coronaviruses represent a significant health threat in this respect. Indeed, the ongoing COVID-19 pandemic represents one of the most significant health threats seen over the past century. Secondary transmission of COVID-19 infections in densely populated spaces, including those having plentiful touch surfaces, has proven especially problematic for this pathogen.

The current COVID-19 pandemic has disrupted normal supply chains and overwhelmed available space in hospitals and other medical facilities. Masks and other types of personal protective equipment are available in increasingly short supply. These factors have created a growing risk of secondary infection transmission among both caregivers and patients, as well as within the general public at large. Oftentimes, the source of secondary infections may result from touch or contact surfaces upon which a pathogen is deposited and then spread to another host. Secondary infection transmission of this type is prevalent with COVID-19. Although rigorous disinfection practices may aid in limiting secondary transmission of this type, they are rarely good enough to stop the cycle of pathogen transfer entirely, and there may not be adequate time or personnel to regularly disinfect all possible surfaces upon which a pathogen may become inadvertently deposited and spread during daily activities.

During the ongoing COVID-19 pandemic, gloves are increasingly being worn by individuals during their daily activities. Gloves may aid in limiting the spread of pathogens, but only if the gloves are worn consistently and properly, and are discarded once they have become contaminated or are no longer providing effective protection. Once they have become contaminated, many gloves are about as effective as human skin for transmitting a pathogen from one surface to another. Similarly, gloves provide little to no protection for a wearer if the gloves become contaminated, and a wearer then touches his or her face with the contaminated gloves. Thus, gloves may give a false sense of security to a wearer and contribute to an ongoing infection transmission cycle, especially to wearers that are inexperienced with proper glove and personal protective equipment use.

As employees return to work during the ongoing COVID-19 pandemic, many employees who were never required to wear personal protective equipment before may now be required to do so, either by their employer or as mandated by local government regulations, or making a personal choice to do so. With personal protective equipment for use by medical professionals still receiving priority, personal protective equipment for use by employees in lower-risk work environments may need to be sufficiently robust for use over long periods of time, such as months or more. Moreover, since employees may not be adequately trained for properly wearing gloves and other personal protective equipment, measures may need to be taken to limit the spread of infection through contaminated and improperly worn personal protective equipment.

Not only does wearing personal protective equipment provide health and safety benefits for an employee and their co-workers, but it also may aid in protecting a company's business continuity plan and limiting the company's liability from fines and lawsuits for failure to provide a safe work environment. With increasing use of communal and non-assigned workspaces, it may be rather difficult to track whether proper company protocols for wearing personal protective equipment are being followed or whether a particular workspace might have become contaminated by an infected individual. In the case of contact tracing for infected individuals, it may not be possible to easily determine where they have been throughout the day and who they might have exposed. Contact tracing and other infection control efforts may be made all the more difficult by an inability to determine whether personal protective equipment is being worn properly or is even being used at all. Thus, there may be risk factors on both the personal and corporate levels as increased workplace interactions begin to take place.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

Figure 1:
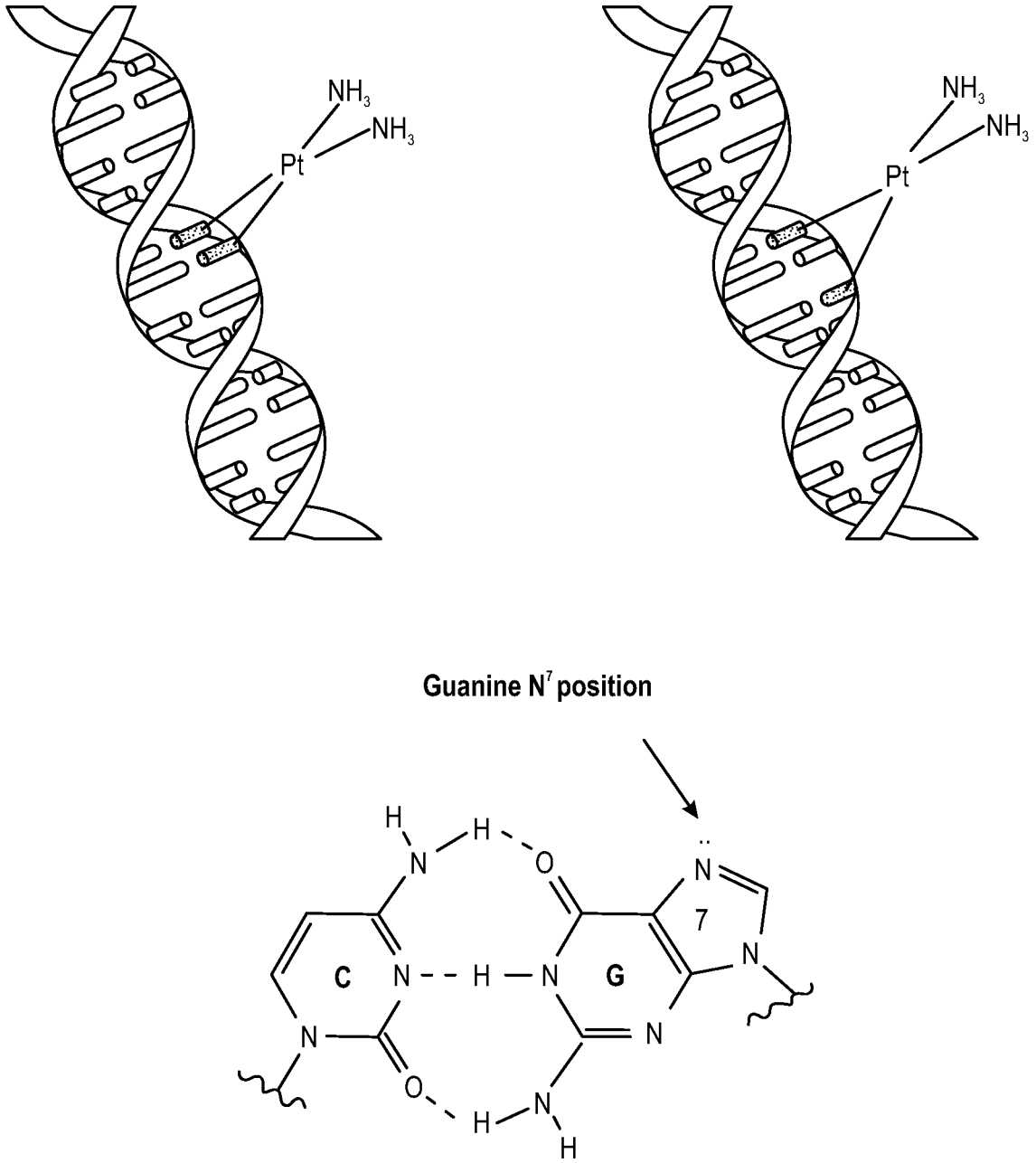
FIG. 1 shows a diagram of the presumed mechanism of action of cisplatin compounds.

The present disclosure relates to garments, gloves and other types of personal protective equipment, which have antiseptic activity conveyed thereto by metal nanoparticle agglomerates. As a consequence of adhering metal nanoparticle agglomerates thereto, the garments, gloves and other personal protective equipment may be rendered essentially self-sterilizing to promote long effective antiseptic lifetimes and facilitate re-use thereof over extended periods of time, especially in areas having relatively low infection risk. The resulting antiseptic activity may significantly mitigate the inadvertent spread of pathogens and further facilitate use or wear by individuals who have limited or no training in the proper use of personal protective equipment.

The garments, gloves and other types of personal protective equipment having adhered metal nanoparticle agglomerates may also include an identifying tag, which may aid in verifying where the articles are being worn and by whom (including for verifying attendance), tracking the usage lifetime thereof, and determining whether an individual has entered a high-risk or verified infection area, any of which may facilitate contact tracing if needed. Because garments, gloves and other types of personal protective equipment having adhered metal nanoparticle agglomerates may be afforded active biocidal activity, rather than providing just passive barrier protection, the ability to track whether these articles are being worn in the various locations may help employers, retailers, and individuals better assess risk and respond to an infection cycle, as explained further herein. As an additional advantage, tracking via an identifying tag may inform how these articles are being used or worn, and this information may provide guidance as to when one may anticipate the usage lifetime to be exceeded. For example, if it is determined through tracking that the garments, gloves and other types of personal protective equipment are being worn under heavy use conditions, especially over extended periods of time, the biocidal activity may wane sooner than under lighter use conditions. Thus, tracking may inform replacement at an appropriate time that is neither too early while biocidal activity is still sufficient nor too late when biocidal activity has waned excessively, thereby balancing cost of goods and safety. Informed monitoring may be especially beneficial in instances where the garments, gloves, and other personal protective equipment do not markedly change color or appearance as the biocidal activity decreases, such when the metal nanoparticle agglomerates are deposited upon a dark material.

Various types of touch or contact surfaces may become contaminated with pathogens, such as viruses and/or bacteria, in the normal course of daily activities. Even under ideal circumstances, it may not be possible to maintain a touch or contact surface in a fully decontaminated condition, due to the nature of the surface or its location, the frequency with which the surface becomes contaminated again after cleaning, or any combination thereof. Such touch or contact surfaces represent a major source for secondary transmission of infections. Garments, gloves and other personal protective equipment may be worn to limit transmission of various pathogens, but if not worn properly or consistently, these items may promote spreading of a pathogen after contacting a contaminated touch or contact surface while providing limited protection for a wearer. For example, a pathogen may contaminate a touch surface of a glove or other personal protective equipment and subsequently be transferred to other touch or contact surfaces by a wearer (or a wearer may even infect themselves), especially those having inadequate training in how to wear gloves or other personal protective equipment. Pathogen transmission from a contaminated touch or contact surface to a glove or similar piece of personal protective equipment is also possible.

Silver and copper surfaces both possess antibacterial activity, even against antibiotic-resistant bacteria in some instances. These metals may also promote viral inactivation. Bulk copper surfaces, for instance, may afford viral inactivation in about 4 hours in some cases, including inactivation of coronaviruses. Silver surfaces tend to be less active and the cost of silver relative to copper may be prohibitive. Viruses may otherwise remain viable for up to five to seven days on various surfaces lacking inherent antiseptic activity. During this time, secondary infection transmissions may occur. Unfortunately, it is rather difficult to incorporate metallic silver or metallic copper upon the materials comprising many types of garments, gloves, personal protective equipment, and various other articles due to the high melting point of these metals. Molten copper, for instance, forms at the melting point of copper (1083° C.), a temperature which is completely incompatible with the base materials used for constructing garments, gloves, personal protective equipment and other articles. The melting point of silver is likewise problematically high. Micron-size silver or copper particles or flakes may be produced, but it may likewise be difficult to promote robust adherence of the metal particles or flakes to a material for maintaining infection control over extended periods of time. The surface area of micron-size metal particles or flakes is also fairly small and not well adapted to convey biocidal activity. In addition, it may be difficult to formulate micron-size metal particles or flakes into a form suitable for rapid dispensation upon a touch or contact surface of garments, gloves, personal protective equipment, or the like, especially by spraying.

Metal nanoparticle agglomerates are uniquely situated to address the foregoing difficulties, since they may readily inactivate a range of microorganisms and viruses, including coronaviruses, and are low toxicity to humans, especially in small amounts. Moreover, once deposited upon a surface, the metal nanoparticle agglomerates may become robustly adhered thereto as a consequence of their high surface energy, as discussed further herein. Additionally, metal nanoparticle agglomerates having a high surface area may be processed into spray, dip coating and/or brush-on formulations that may facilitate ready dispensation onto a fabric or polymer film surface, thereby facilitating ready manufacturing of articles having biocidal activity. The terms "biocidal" and "antiseptic" may be used synonymously herein. As used herein, the terms "spray formulation," "antiseptic spray," "disinfectant spray," and similar terms refer to an aerosolizable fluid medium comprising metal nanoparticle agglomerates, which may be generated with an aerosol propellant, or through pumping or gas pressurization to produce spray droplets. Spray formulations may allow garments, gloves, masks, gowns, and other types of protective coverings to be readily produced with active antiseptic activity being conveyed thereto by way of the metal nanoparticle agglomerates. Spray formulations may also facilitate ready reapplication of metal nanoparticle agglomerates to various articles once prior biocidal activity has waned.

Without being bound by any theory, the mechanism of action of metal nanoparticles agglomerates against various pathogens may result from biomolecule interaction with the metal nanoparticles. With respect to DNA, the mechanism of action may be similar to that of platinum coordination compounds (e.g., cisplatin, carboplatin, oxaliplatin, and pyriplatin), as illustratively shown in FIG. 1. Advantageously, the mechanism of action of metal nanoparticles may address mutations and antibiotic resistance that are becoming increasingly frequent with common disinfectants and pharmaceuticals. Whereas these agents may function through competitive inhibition, metal nanoparticles may facilitate multiple biocidal pathways and lead to more effective biocidal activity that is more resistant to mutations. The metal nanoparticle agglomerates are believed to release metal in a more active form than if individual metal nanoparticles were incorporated directly upon a surface subject to infection, as discussed further herein. Metal nanoparticles may also afford further advantages, as discussed herein.

Metal nanoparticle agglomerates may be incorporated within garments, gloves, personal protective equipment and other articles by application of a suitable metal nanoparticle formulation, such as a spray formulation, to one or more surfaces thereof following manufacturing. Long-lasting infection control may be realized, sometimes in a time-release manner, when metal nanoparticle agglomerates are applied to a surface within garments, gloves and other types of personal protective equipment. Fabrics comprising textile or polymer fibers, or polymer films or sheets may also have metal nanoparticle agglomerates adhered thereto according to the disclosure herein. Advantageously, surfaces having adhered metal nanoparticle agglomerates may undergo a color change as oxidation and/or breakup of the metal nanoparticle agglomerates occurs (provided there is sufficient contrast with a surface upon which the metal nanoparticle agglomerates are deposited), which may provide some indication of loss of biocidal efficacy.

Fabrics or polymer films containing adhered metal nanoparticle agglomerates may be suitable for use in forming garments, gloves and other types of personal protective equipment. Adherence of the metal nanoparticle agglomerates may be realized by spraying metal nanoparticles agglomerates onto a fabric or polymer film using an appropriate spray formulation. Dip coating, painting, printing or brush-on techniques may be used similarly. Application of metal nanoparticle agglomerates may take place at the fabric or film stage, or after the garments, gloves or other personal protective equipment has been formed therefrom and are otherwise ready for wear or use. Spray formulations may allow for a non-uniform distribution of metal nanoparticle agglomerates upon a surface of garments, gloves or other personal protective equipment. A non-uniform distribution of metal nanoparticle agglomerates may allow the metal nanoparticle agglomerates to be localized upon a portion of the surface where they are most needed, such as upon a surface having a high likelihood of coming in contact with a contaminated touch or contact surface.

Metal nanoparticles and their agglomerates, properties of which are addressed in further detail below, represent a highly reactive metal form that may undergo ready adherence to a range of substrates, such as natural and synthetic textile fibers, polymer films, and the like once deposited in small droplet form thereon. Metal nanoparticle agglomerates may be formulated such that they may be readily applied through spraying, brush on, or dip coating onto various fabrics or polymer film substrates. Once applied to a touch or contact surface of garments, gloves or other personal protective equipment, the metal nanoparticle agglomerates may become adhered thereto and facilitate effective infection control, often over extended periods of time. Because the metal nanoparticle agglomerates may be robustly adhered to a wide range of surface types, garments, gloves and other personal protective equipment suitable for use in a wide range of work environments may be formed. For example, occupations requiring more tactile sensitivity may utilize gloves formed from thin polymer films, whereas thicker gloves may be worn in other work environments, such as food service and manufacturing. The thickness of the material comprising a given glove may dictate its suitability for a given work environment. Further, through tracking facilitated with an onboard identifiable tag, the time period over which the metal nanoparticle agglomerates are expected to remain biocidal may be determined.

Metal nanoparticles, such as silver and copper nanoparticles, can be readily produced in a size range that is compatible for processing into spray formulations or related types of formulations that may be suitable for deposition upon a range of surface types. The small size of the metal nanoparticles allows ready dispersion in a fluid medium to be realized and aerosolized droplet formation to take place. In addition, the small size of metal nanoparticles conveys a high surface energy thereto, which may result in the metal nanoparticle agglomerates becoming surface-adhered following droplet formation and deposition upon a touch or contact surface of garments, gloves and other personal protective equipment, thereby providing a robust structure that is capable of repeated handling during use and conveying antiseptic activity to the touch or contact surface. The high surface energy may afford chemical bond formation between the surface and the metal nanoparticle agglomerates in some cases. An adhesive may further facilitate adherence of metal nanoparticle agglomerates to the touch or contact surface in some cases, such as the surface of a fabric or polymer film, as well as promoting a time-release of metal in a more active form (e.g., as smaller agglomerates, individual metal nanoparticles, metal ions, or agglomerates of metal ions) for conveying antiseptic activity over extended periods of time, as discussed hereinafter. After becoming adhered to a surface, the metal nanoparticles within metal nanoparticle agglomerates may retain their nanoparticulate structure, which may provide still further advantages, as also discussed in further detail hereinafter.

Application of an adhesive to a surface prior to or during deposition of metal nanoparticle agglomerates thereon via spraying or another suitable deposition technique may afford initial sequestration of the metal nanoparticles during deposition, followed by more robust adherence being realized through surface bonding taking place as a result of the high surface energy of the metal nanoparticles. As a further advantage, an adhesive may promote prolonged release of active metal species from metal nanoparticle agglomerates following their adherence to a surface, as discussed further below. Once metal nanoparticle agglomerates have been introduced to a surface, particularly in the presence of a suitable adhesive, biocidal activity may be maintained over an extended time, such as over a period of days to weeks.

As used herein, the term "metal nanoparticles" refers to metal particles that are about 250 nm or less in size, particularly about 200 nm or less in size or about 150 nm or less in size, without particular reference to the shape of the metal particles. Copper nanoparticles are metal nanoparticles comprising predominantly copper, optionally with an oxide coating wholly or partially covering the surface of the copper nanoparticles. Likewise, silver nanoparticles are metal nanoparticles comprising predominantly silver, optionally with an oxide coating wholly or partially covering the surface of the silver nanoparticles. The term "metal nanoparticle" broadly refers herein to any metallic structure having at least one dimension of 250 nm or less, particularly about 200 nm or less in size or about 150 nm or less in size, and includes other structures that are not substantially spherical in nature, such as metal platelets/disks, metal nanowires, or the like. Other metal nanostructures that can be dispersed in a spray formulation, dip coating formulation, paint, ink or brush-on formulation, as discussed herein, may be used in addition to or as alternatives to spherical or substantially spherical metal nanoparticles, or agglomerates thereof, in the disclosure herein.

The term "metal nanoparticle agglomerates" and equivalent grammatical forms thereof refers to a grouping of metal nanoparticles having at least one dimension ranging from about 0.1 microns to about 35 microns in size, particularly about 0.1 microns to about 15 microns in size, and more particularly about 0.1 microns to about 5 microns in size. Individual metal nanoparticles within a metal nanoparticle agglomerate may reside within the size ranges indicated above, and the individual metal nanoparticles may be associated with one another through non-covalent, covalent, or metallic bonding interactions.

The term "associated" refers to any type of bonding force that holds a grouping of metal nanoparticles together. The bonding force may be overcome to produce individual metal nanoparticles or smaller metal nanoparticle agglomerates (clusters) in some instances.

The terms "consolidate," "consolidation" and other variants thereof are used interchangeably herein with the terms "fuse," "fusion" and other variants thereof. These terms refer to at least partial coalescence of metal nanoparticles.

Once a surfactant coating has been lost from the surface of metal nanoparticles, as discussed further below, surface oxidation of the metal nanoparticles may occur. Oxidation of metal nanoparticles may also lead to formation of reactive and potentially mobile salt compounds upon a surface. Such salts may include, for example, formates, acetates, chlorides, bisulfites and bicarbonates, resulting from chloride in sweat, carbon dioxide or sulfur dioxide in air or breath, or the like. The salt compounds may be present as a surface coating upon at least a portion of the metal nanoparticles. Formation of such salts may be particularly prevalent upon exposure of the metal nanoparticles to a moist environment, as specified in Reactions 1 and 2 below. Dry conditions, in contrast, may favor formation of at least a partial oxide coating upon the surface of the metal nanoparticles, as specified in Reaction 3 below.

$$Cu+\tfrac{1}{2}O_2+H_2O+2CO_2 \rightarrow Cu(HCO_3)_2 \quad \text{(Reaction 1)}$$

$$Cu+\tfrac{1}{2}O_2+H_2O+2SO_2 \rightarrow Cu(HSO_3)_2 \quad \text{(Reaction 2)}$$

$$Cu+\tfrac{1}{2}O_2 \rightarrow Cu_2O \quad \text{(Reaction 3)}$$

The salts may be surfactant-stabilized salt complexes comprising one or more surfactants (e.g., one or more amine surfactants in the case of copper nanoparticles and sufficient salt anions to achieve charge balance). Charge balancing anions may include, for example, halogen, particularly chloride; bisulfite; bicarbonate; acetate; formate; benzoate; lactate; citrate; or the like. The charge balancing anions are relatively labile and may be released to generate open coordination sites for binding DNA, proteins, or like biomolecules. The surfactant-stabilized salt complexes may be relatively mobile upon the surface of a fabric or polymer film and provide a higher effective coverage of metal nanoparticles thereupon compared to if they remained fully fixed in place.

In addition to salt compounds or surfactant-stabilized forms thereof formed in situ during use, metal salts or surfactant-stabilized forms thereof may be combined with metal nanoparticles or metal nanoparticle agglomerates prior to deposition of the metal nanoparticle agglomerates upon a fabric, polymer film or any other surface subject to infection. Any of the preceding counteranion forms of the metal salts may be utilized in the disclosure herein. Surprisingly, metal salts or surfactant-stabilized forms thereof may themselves aid in killing or inactivating viruses or bacteria upon release from metal nanoparticle agglomerates. When present, the added metal salt compounds may be present at a ratio ranging from about 0.01 to about 0.001 on a weight basis with respect to the metal nanoparticles. The added metal salt compounds may also be deposited upon a fabric or polymer film separately from the metal nanoparticles or metal nanoparticle agglomerates, such as by forming a solution of metal salt in a solvent such as an alcohol or acetone, for example, which may be contacted with the fabric or polymer film through spraying or dip coating. The concentration of metal salt in a spray or dip coating formulation may range from about 0.5 ppm to about 50 ppm. The coating density of the added metal salt upon a fabric or polymer film may range from about 0.01 to about 0.5 mg/in$^2$ or about 0.01 mg/in$^2$ to about 0.1 mg/in$^2$.

In some embodiments, added metal salt compounds may be associated with amine, sulfur, or phosphate functional groups upon a functionalized polymer. The metal salt compounds may be associated with the functional groups by a metal-ligand bond (e.g., in the case of an amine-functionalized polymer) or through salt formation (e.g., in the case of a sulfonic acid-functionalized polymer). Thiol-functionalized polymers or sulfide-functionalized polymers may also coordinate added metal salt compounds. Disulfide-cross-linked polymers, in the presence of a suitable reducing agent, may similarly coordinate added metal salt compounds. Reactions 4-6 below show some of the transformations that added $CuCl_2$ may undergo (R is a polymer chain).

$$R{-}SO_3H+CuCl_2 \rightarrow R{-}SO_3{-}CuCl+HCl \quad \text{(Reaction 4)}$$

$$R{-}NH_2+CuCl_2 \rightarrow R{-}NH_2CuCl_2 \quad \text{(Reaction 5)}$$

$$R_2S+CuCl_2 \rightarrow R_2SCuCl_2 \quad \text{(Reaction 6)}$$

Before further discussing more particular aspects of the present disclosure in more detail, additional brief description of metal nanoparticles and their processing conditions, particularly silver or copper nanoparticles, will first be provided. Metal nanoparticles exhibit a number of properties that can differ significantly from those of the corresponding bulk metal. One property of metal nanoparticles that can be of particular importance for processing is nanoparticle fusion (consolidation) that occurs at the metal nanoparticles' fusion temperature. As used herein, the term "fusion temperature" refers to the temperature at which a metal nanoparticle liquefies, thereby giving the appearance of melting. At or above the fusion temperature, consolidation with other metal nanoparticles may readily take place. Once disposed upon a surface, individual metal nanoparticles or metal nanoparticles within metal nanoparticle agglomerates may undergo fusion with one another as well, thereby forming a network of at least partially fused metal nanoparticles in either case. In other particular examples, metal nanoparticles in the metal nanoparticle agglomerates may remain unfused to one another when adhered to a surface. Metal nanoparticle agglomerates result when metal nanoparticles associate together prior to deposition upon a surface but individual metal nanoparticles are still identifiable. Such metal nanoparticle agglomerates may be particularly desirable for time-releasing individual metal in a more active form for conveying extended antiseptic activity to a surface (e.g., as individual metal nanoparticles, smaller nanoparticle clusters, metal ions, or metal ion clusters).

Advantageously and surprisingly, metal nanoparticles, such as silver and/or copper nanoparticles, can become adhered to various touch surfaces of a fabric or polymer film even well below their fusion temperature, thereby allowing surface bonding to take place, as discussed further herein. Adherence may be promoted by a surfactant coating upon the metal nanoparticles, as well as the high surface area of nanoparticle agglomerates, which may afford high van der Waals interaction forces. Depending on the density at which metal nanoparticle agglomerates are loaded onto a garment, glove or other personal protective equipment and the temperature at which they are processed thereon, individual metal nanoparticles may or may not be further fused together when adhered thereto. Desirably, the metal nanoparticles may remain at least partially unfused to facilitate time-release of metal in a more active form, such as in metal ion form, from metal nanoparticle agglomerates. Oxidized metal forms may be released from metal nanoparticle agglomerates upon a surface as well. When applying a metal nanoparticle formulation to a touch surface of garments, gloves or other personal protective equipment, further heating may or may not be performed, depending upon the extent of metal nanoparticle fusion that is desired. The temperature may remain sufficiently low that the metal nanoparticles do not become fused together while being further processed. Even when metal nanoparticles remain as individual metal nanoparticles or agglomerates thereof, robust adherence to a touch or contact surface may be realized by virtue of the metal nanoparticles' high surface energy.

When seeking to facilitate biocidal activity, metal nanoparticle agglomerates containing larger metal nanoparticles may be advantageous in several respects compared to individual metal nanoparticles of smaller size. Individual metal nanoparticles, particularly metal nanoparticles smaller than about 50 nm or about smaller than about 20 nm, may react and lose their biocidal activity rather quickly, especially if excessive oxidation occurs. Metal nanoparticle agglomerates, in contrast, are more stable and may convey a time-release profile of metal in a more active form that is sustained over multiple days, up to about 30 days, for instance. Metal nanoparticle agglomerates of different sizes may extend the range over which suitable biocidal activity may be displayed. In addition, metal nanoparticle agglomerates may exhibit a tortuous, complex surface that provides a high surface area for capturing bacteria, viruses, and other pathogens, and promoting inactivation thereof.

Upon decreasing in size, particularly below about 20 nm in equivalent spherical diameter, the temperature at which metal nanoparticles liquefy drops dramatically from that of the corresponding bulk metal. For example, copper nanoparticles having a size of about 20 nm or less can have fusion temperatures of about 220° C. or below, or about 200° C. or below, or even about 175° C. or below in comparison to bulk copper's melting point of 1083° C. Silver nanoparticles may similarly display a significant deviation from the melting point of bulk silver below a nanoparticle size of about 20 nm. Thus, the consolidation of metal nanoparticles taking place at the fusion temperature as a result of the high surface energy can allow structures containing bulk metal to be fabricated at significantly lower processing temperatures than when working directly with the bulk metal itself as a starting material. More specifically, bulk metal may be dispersed upon various surfaces that would otherwise be thermally incompatible with the processing temperatures required to introduce molten metal thereon. The small particle sizes of the metal nanoparticles, even in agglomerated form, may promote ready dispersion within formulations suitable for application upon a surface, as well as facilitate adherence to the surface. Agglomerates of the metal nanoparticles, wherein the metal nanoparticles are unfused but are associated together, may likewise be dispersible in formulations suitable for application to a surface. Once deposited upon a textile fabric or polymer film, either before or after forming an article therefrom, metal nanoparticle agglomerates may become strongly adhered to the touch or contact surface even without being raised above the fusion temperature and forming bulk metal, as described further hereinbelow. Adherence may be further promoted by an adhesive, which may afford further advantages as well.

A number of scalable processes have been developed for producing bulk quantities of metal nanoparticles in a targeted size range. Most typically, such processes for producing metal nanoparticles take place by reducing a metal precursor in the presence of one or more surfactants. The as-isolated metal nanoparticles may have a surfactant coating thereon and be isolated as a plurality of nanoparticle agglomerates. The agglomerates may be broken apart, while retaining the surfactant coating, or the agglomerates may be used directly without further processing. Particularly advantageous metal nanoparticle agglomerates for promoting infection control may include metal nanoparticles ranging from about 50 nm to about 250 nm in size, or about 50 nm to about 150 nm in size. The agglomerates may convey a time-release profile of metal in a more active form upon a surface, thereby facilitating surfactant loss from individual metal nanoparticles and surface adhesion thereof, particularly in the presence of moisture. While present, the surfactants themselves may facilitate surface adhesion through van der Waals interactions. The surfactants needs not necessarily be lost in order to for biocidal activity to be realized.

The metal nanoparticle agglomerates may be of an advantageous size range to facilitate dispensation via spraying and to promote retention upon a garment, glove or personal protective equipment, such an agglomerate size ranging from about 0.1 microns to about 35 microns or about 0.5 microns to about 5 microns. The metal nanoparticle agglomerates can be isolated and purified from the reaction mixture by common isolation techniques and processed into a suitable spray formulation, dip coating formulation, or brush-on formulation for surface dispensation. If desired, the surfactant coating of the metal nanoparticles may be removed through gentle heating, gas flow, and/or vacuum (any pressure below atmospheric pressure) once the metal nanoparticles have been deposited upon a surface, thereby affording a much higher surface energy and a commensurate increase in reactivity. Alternately, the surfactant coating may be lost upon extended contact with a surface without undergoing additional heating or other processing, with adherence to the surface occurring following surfactant loss. The surfactant coating may also remain for at least some period of time upon a touch surface of gloves and other personal protective equipment, such that the metal nanoparticles are retained as individuals within a metal nanoparticle agglomerate. Once the surfactant coating has been removed or lost, the high surface energy of the metal nanoparticles may facilitate adherence of the metal nanoparticles to a surface. The metal nanoparticles may or may not become fused together during this process. At least some surface adhesion may also be realized without the surfactant coating being removed.

Metal nanoparticle agglomerates having a range of sizes, such as those within a range of about 0.1 microns to about 35 microns, or about 0.1 microns to about 15 microns, or about 0.1 microns to about 5 microns, or about 0.5 microns to about 5 microns, or about 3 microns to about 5 microns may be advantageous in terms of their ability to be dispensed through aerosol formation. Metal nanoparticle agglomerates within any of these size ranges may be utilized in the disclosure herein. Moreover, agglomerates of metal nanoparticles having different agglomerate sizes may release metal in a more active form at different rates. As metal in a more active form is released from the agglomerates at different rates, the metal (e.g., smaller metal nanoparticle clusters, metal ions, metal ion clusters and/or the like) may migrate over a surface to afford biocidal coverage that appears more complete than is the actual coverage density of the metal nanoparticle agglomerates upon the surface. Thus, the metal nanoparticles may attack pathogens in any vicinity of the surface, so long as metal nanoparticle agglomerates are sufficiently close by to release active metal to the surface in a mobile form. By differentially releasing metal in an active form from the metal nanoparticle agglomerates having a range of sizes, a time-release profile of active-form metal may be realized to afford prolonged and rapid biocidal activity. Thus, activity against various pathogens may be retained over several days, such as at least about 3 days, or at least about 5 days, or at least about 7 days, or at least about 10 days, or at least about 14 days, or at least about 21 days, or at least about 30 days. An adhesive in contact with the metal nanoparticle agglomerates may further facilitate a time-release profile of metal in a more active form effective to promote biocidal activity. Suitable adhesives within an adhesive layer are not considered to be particularly limited and are specified in more detail below.

Any suitable technique can be employed for forming the metal nanoparticles used in the disclosure herein. Particularly facile metal nanoparticle fabrication techniques, particularly for copper nanoparticles, are described in U.S. Pat. Nos. 7,736,414, 8,105,414, 8,192,866, 8,486,305, 8,834,747, 9,005,483, 9,095,898, and 9,700,940, each of which is incorporated herein by reference in its entirety. Similar procedures may be used for synthesizing silver nanoparticles. As described therein, metal nanoparticles can be fabricated in a narrow size range by reduction of a metal salt in a solvent in the presence of a suitable surfactant system, which can include one or more different surfactants. Further description of suitable surfactant systems follows below. Tailoring of the surfactant system, the reaction concentration, temperature, and like factors may determine the size range of metal nanoparticles that are obtained from a metal nanoparticle synthesis. Without being bound by any theory or mechanism, it is believed that the surfactant system can mediate the nucleation and growth of the metal nanoparticles, limit surface oxidation of the metal nanoparticles while the surfactant system is adhered thereto, and/or inhibit metal nanoparticles from extensively aggregating with one another prior to being at least partially fused together. As noted above, small agglomerates of metal nanoparticles may be formed in many instances. Suitable organic solvents for solubilizing metal salts and forming metal nanoparticles can include, for example, formamide, N,N-dimethylformamide, dimethyl sulfoxide, dimethylpropylene urea, hexamethylphosphoramide, tetrahydrofuran, glyme, diglyme, triglyme, tetraglyme, proglyme, or polyglyme. Reducing agents suitable for reducing metal salts and promoting the formation of metal nanoparticles can include, for example, an alkali metal in the presence of a suitable catalyst (e.g., lithium naphthalide, sodium naphthalide, or potassium naphthalide) or borohydride reducing agents (e.g., sodium borohydride, lithium borohydride, potassium borohydride, or tetraalkylammonium borohydrides).

Figure 2:
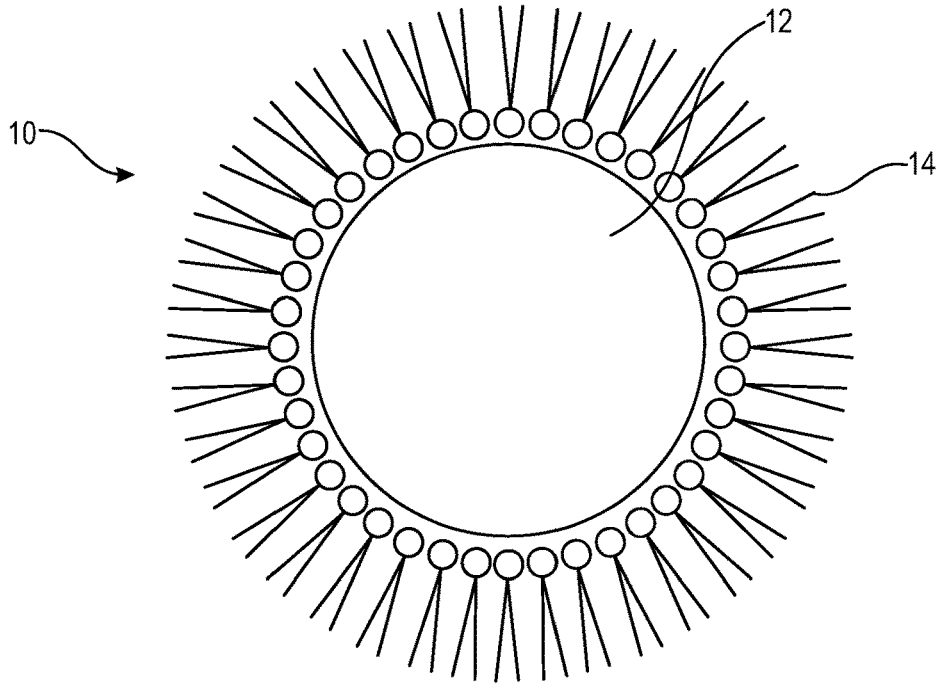
FIGS. 2 and 3 show diagrams of presumed structures of metal nanoparticles having a surfactant coating thereon.
Figure 3:
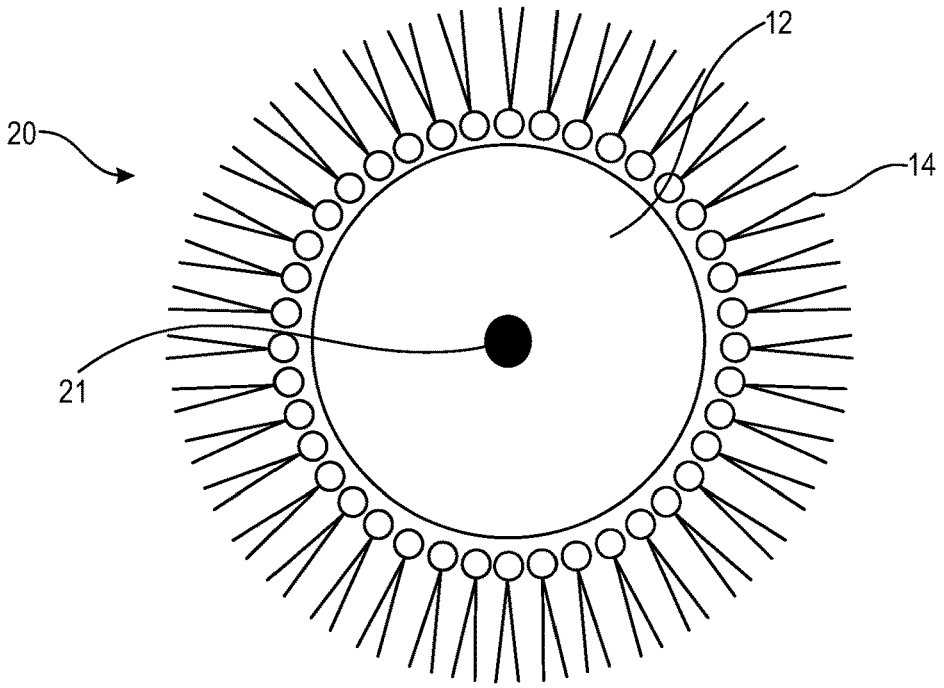
Figure 4:
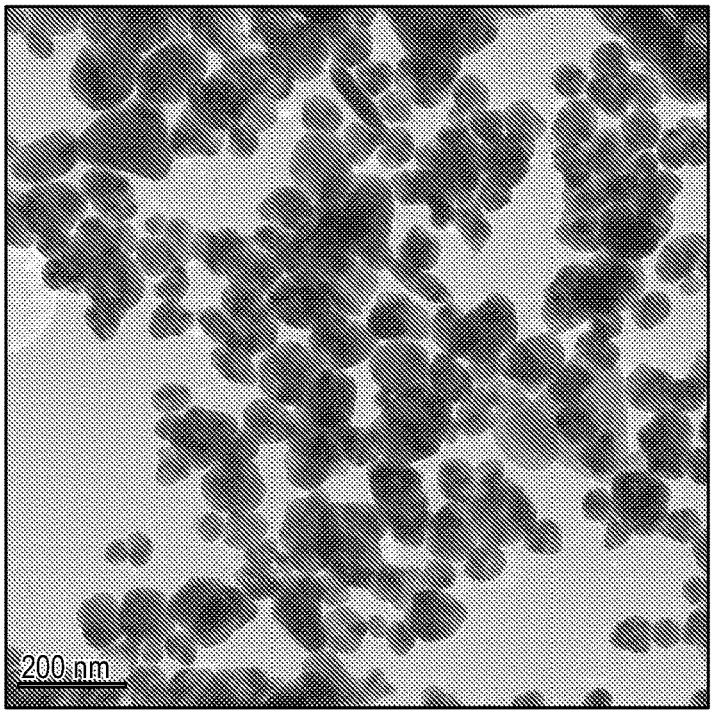
FIG. 4 shows an illustrative SEM image of substantially individual copper nanoparticles.
Figure 5:
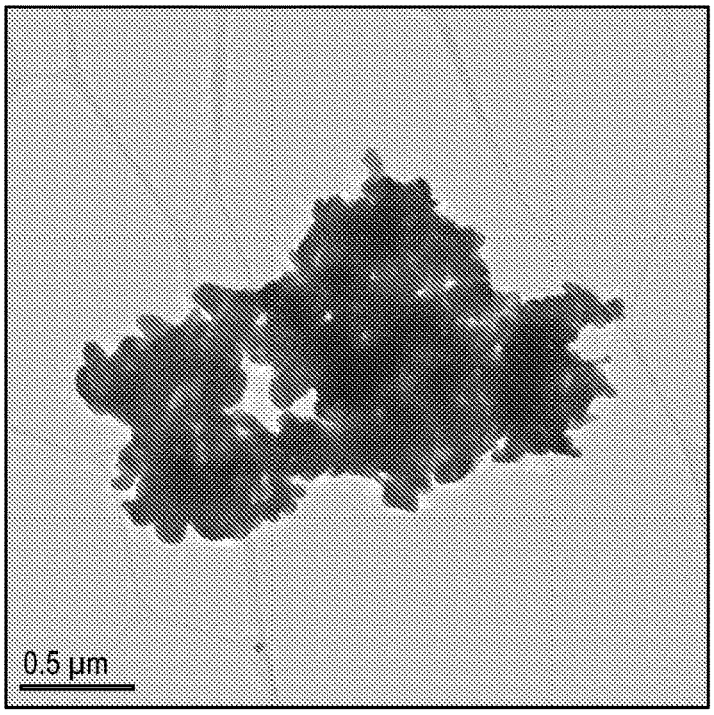
FIG. 5 shows an illustrative SEM image of an agglomerate of copper nanoparticles.
Figure 6:
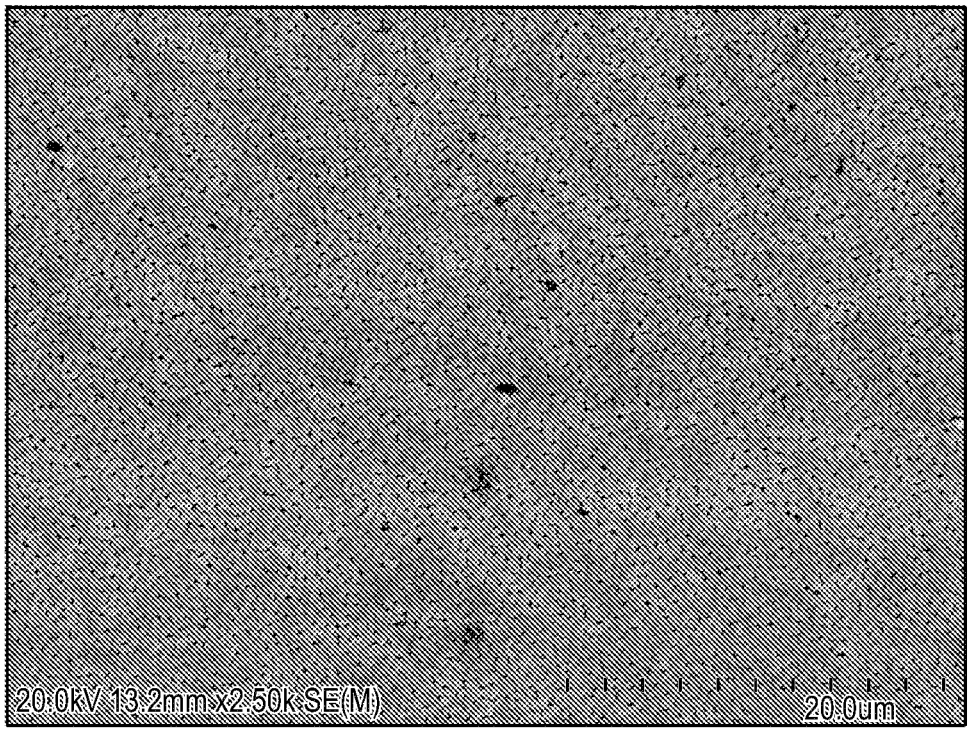
FIG. 6 shows an illustrative SEM image of a copper nanoparticle network obtained after fusion of a plurality of copper nanoparticles to each other.
Figure 7A:
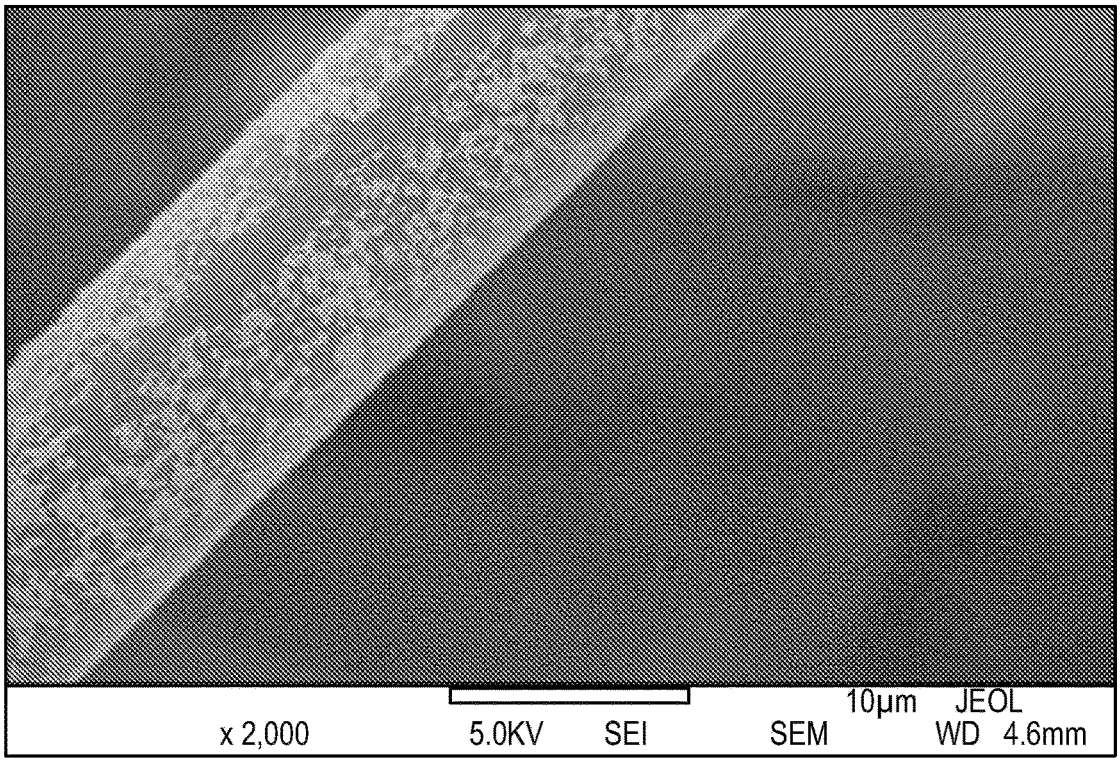
FIGS. 7A and 7B show illustrative SEM images of copper nanoparticles disposed upon fibers of a mask.
Figure 7B:
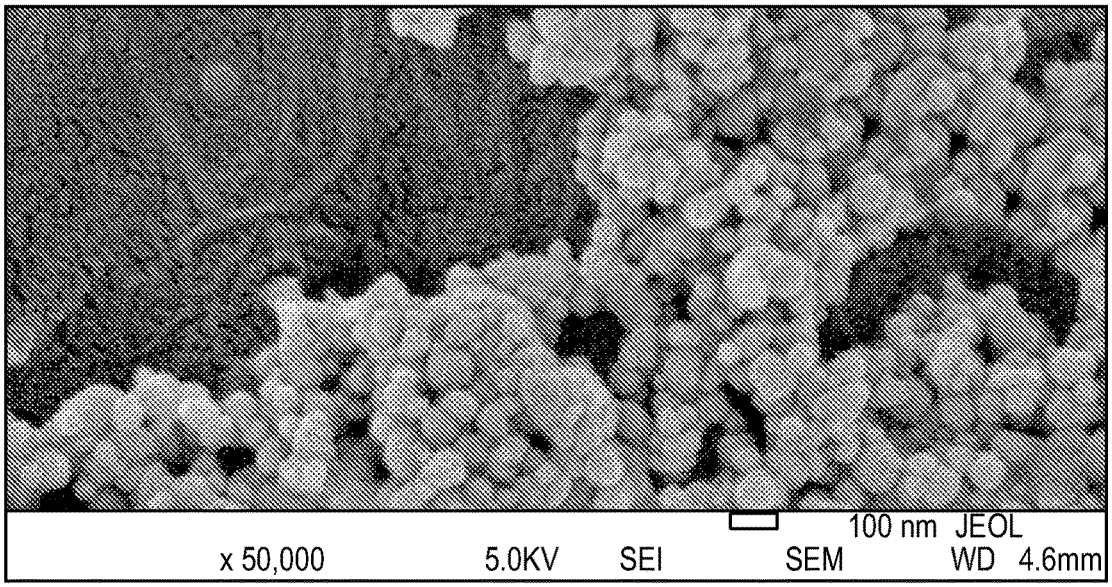

FIGS. 2 and 3 show diagrams of presumed structures of metal nanoparticles having a surfactant coating thereon. As shown in FIG. 2, metal nanoparticle 10 includes metallic core 12 and surfactant layer 14 overcoating metallic core 12. Surfactant layer 14 can contain any combination of surfactants, as described in more detail below. Metal nanoparticle 20, shown in FIG. 3, is similar to that depicted in FIG. 2, except metallic core 12 is grown about nucleus 21. Because nucleus 21 is buried deep within metallic core 12 in metal nanoparticle 20 and is very small in size, it is not believed to significantly affect the overall nanoparticle properties. Nucleus 21 may comprise a salt or a metal, wherein the metal may be the same as or different than that of metallic core 12. In some embodiments, the nanoparticles can have an amorphous morphology. FIGS. 2 and 3 may be representative of the microscopic structure of copper or silver nanoparticles suitable for use in the disclosure herein. FIG. 4 shows an illustrative SEM image of substantially individual copper nanoparticles. FIG. 5 shows an illustrative SEM image of an agglomerate of copper nanoparticles, which may be used in the disclosure herein. FIG. 6 shows an illustrative SEM image of a copper nanoparticle network obtained after fusion of a plurality of copper nanoparticles to each other. FIGS. 7A and 7B show illustrative SEM images of copper nanoparticles adhered to the fibers of a mask following spraying thereon. The copper nanoparticles are robustly adhered to the mask fibers but do not undergo fusion with one another. The adherence of copper nanoparticles to the textile fibers of a mask may be representative of the adherence of metal nanoparticle agglomerates to other touch or contact surfaces according to the disclosure herein.

As discussed above, the metal nanoparticles have a surfactant coating containing one or more surfactants upon their surface. The surfactant coating can be formed on the metal nanoparticles during their synthesis. Formation of a surfactant coating upon metal nanoparticles during their syntheses can desirably limit the ability of the metal nanoparticles to fuse to one another prematurely, limit agglomeration of the metal nanoparticles to a desired extent or agglomerate size, and promote the formation of a population of metal nanoparticles having a narrow size distribution. At least partial loss of the surfactant coating may occur upon heating the metal nanoparticles up to the fusion temperature, including at least some surfactant loss well below the fusion temperature for low-boiling surfactants. Surfactant loss may be further promoted by flowing gas and/or application of vacuum (reduced pressure), as desired, even below the fusion temperature. At least some surfactant loss may occur at room temperature and ambient pressure conditions in some instances when the metal nanoparticles are deposited upon a surface of garments, gloves or personal protective equipment. Following surfactant loss, fusion of the metal nanoparticles may take place above the fusion temperature. If the metal nanoparticles are not heated above the fusion temperature, an uncoated metal nanoparticle having a high surface energy may be obtained. The high surface energy may promote adherence of the metal nanoparticles to a touch surface of gloves and other personal protective equipment. The metal nanoparticles may become adhered to a touch surface even below the fusion temperature once the surfactant coating has been removed. When heated above the fusion temperature, nanoparticle fusion may take place in combination with the metal nanoparticles becoming adhered to the touch surface, provided multiple metal nanoparticles are packed sufficiently close together. When copper nanoparticles and silver nanoparticles are present upon a surface together, fusion between the copper nanoparticles and the silver nanoparticles may occur as well. Combinations of copper nanoparticles and silver nanoparticles may afford particular synergy against pathogens not remediated adequately with a single metal alone, including conveying biocidal activity against different pathogens and/or enhancing activity against a particular pathogen.

Various types of metal nanoparticles may be synthesized by metal reduction in the presence of one or more suitable surfactants, such as copper nanoparticles or silver nanoparticles. Copper and/or silver can be particularly desirable metals for use in the embodiments of the present disclosure due to their ability to promote pathogen killing or inactivation when deposited upon a surface. Copper may also be advantageous due to its low cost. Zinc can similarly display biocidal activity against bacteria, viruses and similar microorganisms and may be substituted for copper or silver in any of the embodiments disclosed herein, or used in combination with these metals. NiO and $TiO_2$ may be used similarly in this respect. Nanoparticle forms of Zn, Ni and Ti may be used.

In various embodiments, the surfactant system present within the metal nanoparticles can include one or more surfactants. The differing properties of various surfactants can be used to tailor the properties of the metal nanoparticles. Factors that can be taken into account when selecting a surfactant or combination of surfactants for inclusion upon the metal nanoparticles can include, for example, ease of surfactant dissipation from the metal nanoparticles during or prior to nanoparticle fusion, nucleation and growth rates of the metal nanoparticles to impact the nanoparticle size, the metal component of the metal nanoparticles, the extent of agglomeration needed, and the like. Main group metals, for example, may require different surfactants than do transition metals.

In some embodiments, an amine surfactant or combination of amine surfactants, particularly aliphatic amines, can be present upon the metal nanoparticles. Amine surfactants can be particularly desirable for use in conjunction with copper nanoparticles or silver nanoparticles due to their good affinity for these transition metals. In some embodiments, two amine surfactants can be used in combination with one another. In other embodiments, three amine surfactants can be used in combination with one another. In more specific embodiments, a primary amine, a secondary amine, and a diamine chelating agent can be used in combination with one another. In still more specific embodiments, the three amine surfactants can include a long chain primary amine, a secondary amine, and a diamine having at least one tertiary alkyl group nitrogen substituent. Further disclosure regarding suitable amine surfactants follows hereinafter.

In some embodiments, the surfactant system can include a primary alkylamine. In some embodiments, the primary alkylamine can be a $C_2$-$C_{18}$ alkylamine. In some embodiments, the primary alkylamine can be a $C_7$-$C_{10}$ alkylamine. In other embodiments, a $C_5$-$C_6$ primary alkylamine can also be used. Without being bound by any theory or mechanism, the exact size of the primary alkylamine can be balanced between being long enough to provide an effective inverse micelle structure during synthesis versus having ready volatility and/or ease of handling during nanoparticle consolidation. For example, primary alkylamines with more than 18 carbons can also be suitable for use in the present embodiments, but they can be more difficult to handle because of their waxy character. $C_7$-$C_{10}$ primary alkylamines, in particular, can represent a good balance of desired properties for ease of use.

In some embodiments, the $C_2$-$C_{18}$ primary alkylamine can be n-hexylamine, n-heptylamine, n-octylamine, n-nonylamine, or n-decylamine, for example. While these are all straight chain primary alkylamines, branched chain primary alkylamines can also be used in other embodiments. For example, branched chain primary alkylamines such as, for example, 7-methyloctylamine, 2-methyloctylamine, or 7-methylnonylamine can be used. In some embodiments, such branched chain primary alkylamines can be sterically hindered where they are attached to the amine nitrogen atom. Non-limiting examples of such sterically hindered primary alkylamines can include, for example, t-octylamine, 2-methylpentan-2-amine, 2-methylhexan-2-amine, 2-methylheptan-2-amine, 3-ethyloctan-3-amine, 3-ethylheptan-3-amine, 3-ethylhexan-3-amine, and the like. Additional branching can also be present. Without being bound by any theory or mechanism, it is believed that primary alkylamines can serve as ligands in the metal coordination sphere but be readily dissociable therefrom during metal nanoparticle consolidation.

In some embodiments, the surfactant system can include a secondary amine. Secondary amines suitable for forming metal nanoparticles can include normal, branched, or cyclic $C_4$-$C_{12}$ alkyl groups bound to the amine nitrogen atom. In some embodiments, the branching can occur on a carbon atom bound to the amine nitrogen atom, thereby producing significant steric encumbrance at the nitrogen atom. Suitable secondary amines can include, without limitation, dihexylamine, diisobutylamine, di-t-butylamine, dineopentylamine, di-t-pentylamine, dicyclopentylamine, dicyclohexylamine, and the like. Secondary amines outside the $C_4$-$C_{12}$ range can also be used, but such secondary amines can have undesirable physical properties such as low boiling points or waxy consistencies that can complicate their handling.

In some embodiments, the surfactant system can include a chelating agent, particularly a diamine chelating agent. In some embodiments, one or both of the nitrogen atoms of the diamine chelating agent can be substituted with one or two alkyl groups. When two alkyl groups are present on the same nitrogen atom, they can be the same or different. Further, when both nitrogen atoms are substituted, the same or different alkyl groups can be present. In some embodiments, the alkyl groups can be $C_1$-$C_6$ alkyl groups. In other embodiments, the alkyl groups can be $C_1$-$C_4$ alkyl groups or $C_3$-$C_6$ alkyl groups. In some embodiments, $C_3$ or higher alkyl groups can be straight or have branched chains. In some embodiments, $C_3$ or higher alkyl groups can be cyclic. Without being bound by any theory or mechanism, it is believed that diamine chelating agents can facilitate metal nanoparticle formation by promoting nanoparticle nucleation.

In some embodiments, suitable diamine chelating agents can include N,N'-dialkylethylenediamines, particularly $C_1$-$C_4$ N,N'-dialkylethylenediamines. The corresponding methylenediamine, propylenediamine, butylenediamine, pentylenediamine or hexylenediamine derivatives can also be used. The alkyl groups can be the same or different. $C_1$-$C_4$ alkyl groups that can be present include, for example, methyl, ethyl, propyl, and butyl groups, or branched alkyl groups such as isopropyl, isobutyl, s-butyl, and t-butyl groups. Illustrative N,N'-dialkylethylenediamines that can be suitable for inclusion upon metal nanoparticles include, for example, N,N'-di-t-butylethylenediamine, N,N'-diisopropylethylenediamine, and the like.

In some embodiments, suitable diamine chelating agents can include N,N,N',N'-tetraalkylethylenediamines, particularly $C_1$-$C_4$ N,N,N',N'-tetraalkylethylenediamines. The corresponding methylenediamine, propylenediamine, butylenediamine, pentylenediamine or hexylenediamine derivatives can also be used. The alkyl groups can again be the same or different and include those mentioned above. Illustrative N,N,N',N'-tetraalkylethylenediamines that can be suitable for use in forming metal nanoparticles include, for example, N,N,N',N'-tetramethylethylenediamine, N,N,N',N'-tetraethylethylenediamine, and the like.

Surfactants other than aliphatic amines can also be present in the surfactant system. In this regard, suitable surfactants can include, for example, pyridines, aromatic amines, phosphines, thiols, or any combination thereof. These surfactants can be used in combination with an aliphatic amine, including those described above, or they can be used in a surfactant system in which an aliphatic amine is not present. Further disclosure regarding suitable pyridines, aromatic amines, phosphines, and thiols follows below.

Suitable aromatic amines can have a formula of $ArNR^1R^2$, where Ar is a substituted or unsubstituted aryl group and $R^1$ and $R^2$ are the same or different. $R^1$ and $R^2$ can be independently selected from H or an alkyl or aryl group containing from 1 to about 16 carbon atoms. Illustrative aromatic amines that can be suitable for use in forming metal nanoparticles include, for example, aniline, toluidine, anisidine, N,N-dimethylaniline, N,N-diethylaniline, and the like. Other aromatic amines that can be used in conjunction with metal nanoparticles can be envisioned by one having ordinary skill in the art.

Suitable pyridines can include both pyridine and its derivatives. Illustrative pyridines that can be suitable for inclusion upon metal nanoparticles include, for example, pyridine, 2-methylpyridine, 2,6-dimethylpyridine, collidine, pyridazine, and the like. Chelating pyridines such as bipyridyl chelating agents may also be used. Other pyridines that can be used in conjunction with metal nanoparticles can be envisioned by one having ordinary skill in the art.

Suitable phosphines can have a formula of $PR_3$, where R is an alkyl or aryl group containing from 1 to about 16 carbon atoms. The alkyl or aryl groups attached to the phosphorus center can be the same or different. Illustrative phosphines that can be present upon metal nanoparticles include, for example, trimethylphosphine, triethylphosphine, tributylphosphine, tri-t-butylphosphine, trioctylphosphine, triphenylphosphine, and the like. Phosphine oxides can also be used in a like manner. In some embodiments, surfactants that contain two or more phosphine groups configured for forming a chelate ring can also be used. Illustrative chelating phosphines can include 1,2-bisphosphines, 1,3-bisphosphines, and bis-phosphines such as BINAP, for example. Other phosphines that can be used in conjunction with metal nanoparticles can be envisioned by one having ordinary skill in the art.

Suitable thiols can have a formula of RSH, where R is an alkyl or aryl group having from about 4 to about 16 carbon atoms. Illustrative thiols that can be present upon metal nanoparticles include, for example, butanethiol, 2-methyl-2-propanethiol, hexanethiol, octanethiol, benzenethiol, and the like. In some embodiments, surfactants that contain two or more thiol groups configured for forming a chelate ring can also be used. Illustrative chelating thiols can include, for example, 1,2-dithiols (e.g., 1,2-ethanethiol) and 1,3-dithiols (e.g., 1,3-propanethiol). Other thiols that can be used in conjunction with metal nanoparticles can be envisioned by one having ordinary skill in the art.

As mentioned above, a distinguishing feature of metal nanoparticles is their high surface energy, which may promote adherence to garments, gloves, personal protective equipment and other articles having touch or contact surfaces. A surfactant associated with the metal nanoparticles may further facilitate surface adhesion thereof, especially prior to surfactant loss and formation of uncoated metal nanoparticles having a high surface energy. An adhesive may further facilitate metal nanoparticle adhesion to a fabric or polymer film, as well as to promote extended release of metal in a more active form from the metal nanoparticle agglomerates.

Gloves having antiseptic activity may comprise a body having one or more touch surfaces when worn, and metal nanoparticle agglomerates adhered to a material defining the one or more touch surface. Garments or other personal protective equipment may similarly feature adherence of metal nanoparticle agglomerates to a touch or contact surface thereof. In the case of a glove, the touch surface may comprise a palm portion of the glove, a finger portion of the glove, or any combination thereof, which may be more likely to become contaminated during wear. Additional surfaces, which may be non-touch surfaces, such as the knuckle side of the finger portions, or the back side of the hand, may or may not comprise metal nanoparticles or metal nanoparticle agglomerates, since metal nanoparticles in these locations may be less effective for promoting infection control. The additional surfaces may be contiguous with the one or more touch surfaces but are less likely to become contaminated with a pathogen by virtue of their location. Metal nanoparticle agglomerates may be located on the inside surface of gloves next to a wearer's skin, for example, to limit bacterial growth and mitigate odor during extended wear.

Figure 8:
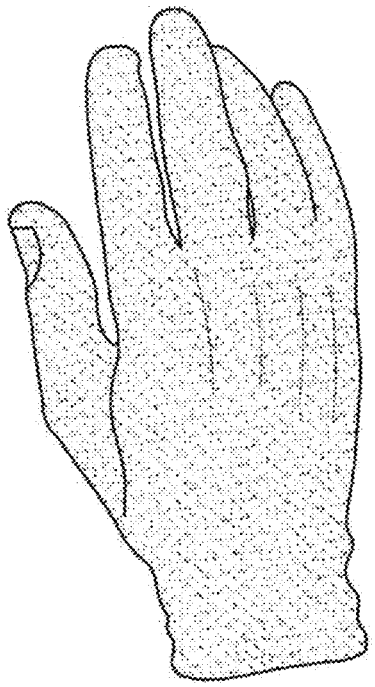
FIG. 8 shows an image of cotton gloves having both touch surfaces and additional surfaces with metal nanoparticle agglomerates adhered thereto.
Figure 9:
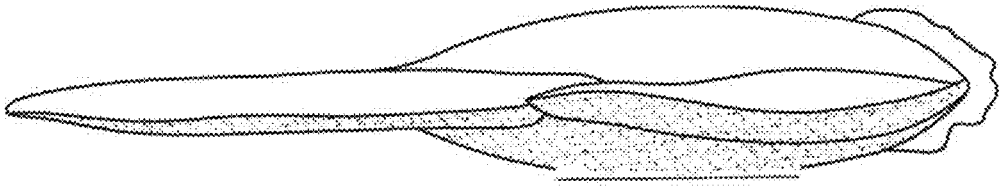
FIG. 9 shows an image of cotton gloves having metal nanoparticle agglomerates adhered only on the palm-side touch surface of the glove.

Alternately, substantially the entire surface of a glove may be contacted with a formulation comprising metal nanoparticle agglomerates, such that both touch surfaces and additional (non-touch) surfaces of the glove may have metal nanoparticle agglomerates adhered thereto. Glove configurations having metal nanoparticle agglomerates only upon the touch surfaces may afford more efficient use of a metal nanoparticle formulation (e.g., a spray-on formulation), but glove configurations having metal nanoparticle agglomerates adhered to both touch surfaces and additional surfaces may be easier to manufacture, such as through dip coating. FIG. 8 shows an image of cotton gloves having both touch surfaces and additional surfaces with metal nanoparticle agglomerates adhered thereto. The dark color of the gloves arises from the metal nanoparticles. FIG. 9 shows an image of cotton gloves with metal nanoparticle agglomerates only on the palm-side touch surface of the glove. The color transition is indicative of the presence or absence of metal nanoparticle agglomerates upon the touch surfaces and the non-touch surfaces, respectively. The dark color of the glove portions containing metal nanoparticle agglomerates is indicative that the metal nanoparticle agglomerates are still in a biocidal-active form. A color change to a lighter hue may occur once metal nanoparticles have become overly oxidized and are providing less or no biocidal activity (see FIG. 10 below). The color change may be readily observable upon surfaces that have a contrasting color to the metal nanoparticles before oxidation of the metal nanoparticles occurs.

When deposited upon a touch or contact surface of a garment, glove or other personal protective equipment, the metal nanoparticle agglomerates may be located predominantly upon the surface of a fabric or polymer film, especially when deposited using a suitable spray formulation. In the case of textile fibers, for example, the metal nanoparticle agglomerates may extend to a depth of about 3-4 fiber layers when deposited thereon according to the disclosure herein. The predominant surface coating may ensure efficient use of the metal nanoparticle agglomerates compared to dip coating processes, wherein metal nanoparticle agglomerates may be deposited throughout predominantly all of the fiber layers. Metal nanoparticle agglomerates buried within deeper fiber layers may be ineffective or less effective for conveying antiseptic activity against a contaminated surface, although migration of active metal forms may still occur, as described further herein. Thus, it is to be appreciated that more deeply buried metal nanoparticle agglomerates may suitably be present in the garments, gloves and personal protective equipment disclosed herein, such as when the metal nanoparticle agglomerates are deposited by dip coating techniques.

The loading of metal nanoparticle agglomerates upon a touch or contact surface of a garment, glove or personal protective equipment may include a coverage density ranging from about 0.03 mg/in$^2$ to about 10 mg/in$^2$, or about 0.1 mg/in$^2$ to about 10 mg/in$^2$, or about 0.5 mg/in$^2$ to about 5 mg/in$^2$, or about 1 mg/in$^2$ to about 2 mg/in$^2$, or about 1 mg/in$^2$ to about 3 mg/in$^2$, or about 0.03 mg/in$^2$ to about 0.1 mg/in$^2$, or about 0.1 mg/in$^2$ to about 0.7 mg/in$^2$, or about 0.7 mg/in$^2$ to about 1.5 mg/in$^2$, or about 1.5 mg/in$^2$ to about 2 mg/in$^2$, or about 2 mg/in$^2$ to about 3 mg/in$^2$, or about 3 mg/in$^2$ to about 10 mg/in$^2$, or about 0.4 mg/in$^2$ to about 5 mg/in$^2$, or about 0.5 mg/in$^2$ to about 3 mg/in$^2$ Loadings of metal nanoparticle agglomerates within these ranges may be accomplished by spraying a spray formulation, dip-coating, painting, or the like. The coverage of metal nanoparticle agglomerates upon the touch or contact surface may range from about 5% to about 95% by area, or about 50% to about 99% by area, or about 60% to 95% by area. Even coverage densities as low as 3-5% by area may be effective for promoting antiseptic activity in the disclosure herein. Coverage densities of added metal salt compounds, when present, may range from about 10-fold to about 1000-fold less than metal nanoparticles upon a surface where they are deposited.

When present at the foregoing coverages and coverage densities, the metal nanoparticle agglomerates may effectively inactivate various pathogens, oftentimes more effectively than does a bulk metal surface comprising the same metal. For example, copper nanoparticles adhered to a fabric surface and retaining their nanoparticulate form may inactivate/kill viruses within about 30 seconds to about 2 minutes, or about 2 minutes to about 5 minutes, or about 3 minutes to about 5 minutes, or even as little as 5-10 seconds. A surface may be disinfected, for example, by wiping the surface for 5-10 seconds with a glove loaded with metal nanoparticle agglomerates. Up to 100% kill rates or inactivation rates may be realized. Bulk copper surfaces, in contrast, may take several hours to reach the same level of inactivation. Because of the time-release profile attainable by utilizing metal nanoparticle agglomerates and/or an adhesive to promote adherence to a touch surface, long-term infection control may be realized.

The metal nanoparticle agglomerates upon garments, gloves, or personal protective equipment may comprise copper nanoparticles, silver nanoparticles, or any combination thereof. Copper nanoparticles in an amount effective to control infection (e.g., coverage of about 60% to about 95% of the touch surface by area and a coverage density of about 1 mg/in$^2$ to about 2 mg/in$^2$, or another coverage and coverage density specified above) may be especially efficacious for mitigating infection spread from bacteria and viruses. Without being bound by any theory or mechanism, it is believed that Cu(0) may be oxidized to Cu(I) on a surface in a slow process, with further oxidation to Cu(II) taking place rapidly thereafter. Release of these oxidized metal species may take place from the metal nanoparticle agglomerates. When contacting a pathogen, such as bacteria or viruses, hydroxyl radicals and lipid radicals may form, which may disrupt the outer lipid bilayer or protein shell of a virus or bacterium. In addition, copper may bind to heteroatoms (e.g., S, N or P) within amino acids, proteins, DNA and/or RNA of viruses, bacteria and other pathogens to result in inactivation. Metal penetration within a cell membrane or protein coat may also occur, wherein the metal may inhibit DNA/RNA replication and/or inhibit protein transport. The presumed mechanism of action may lessen the likelihood of pathogen resistance arising.

Metal nanoparticle agglomerates, such as copper nanoparticle agglomerates, may exhibit universal high activity against both viruses and bacteria, including activity against both gram-negative and gram-positive bacteria. This behavior is very unusual, as many antimicrobial agents are only active against one type of bacteria but not the other. Examples of bacteria and viruses that may be mitigated using metal nanoparticle agglomerates include bacteriophages as representatives of non-enveloped viruses, enveloped viruses such as H1N1 flu, H3N2 flu, and SARS-CoV-2, and non-enveloped viruses such as feline calicivirus as well as (but not limited to) *Staphylococcus aureus* (ATCC 6538), *Enterobacter aerogenes* (ATCC 13048), *Pseudomonas aeruginosa* (ATCC 15442), Methicillin Resistant *Staphylococcus aureus* MRSA (ATCC 33592), *Escherichia coli* O157:H7 (ATCC 35150). Metal nanoparticle agglomerates may also be effective against resistant microorganisms, such as hypervirulent carbapenem-resistant *Klebsiella pneumoniae* bacteria. Moreover, metal nanoparticle agglomerates do not appear to proliferate antibiotic resistance.

Combinations of copper nanoparticles and silver nanoparticles may afford synergy against pathogens not remediated adequately with a single metal alone. That is, copper nanoparticles and silver nanoparticles may convey biocidal activity against different pathogens. In addition, enhanced activity against a particular pathogen may be realized when both copper nanoparticles and silver nanoparticles are present, as compared to copper nanoparticles or silver nanoparticles alone.

In non-limiting examples, tracking via an identifying tag in proximity to the metal nanoparticle agglomerates may provide user guidance as to when biocidal activity conveyed by the metal nanoparticle agglomerates is expected to no longer be sufficient. For instance, when worn under heavy use conditions, such as in a gym or when performing manual labor, as non-limiting examples, the biocidal activity may wane more rapidly than under light use conditions. By providing tracking capabilities, a user may determine with improved confidence an appropriate time at which to either replenish the biocidal activity by applying additional metal nanoparticle agglomerates (e.g., by applying a spray formulation) or changing to new garments, gloves or personal protective equipment. These actions may be facilitated by comparing the tracked usage time against known biocidal activity realized under similar usage conditions (e.g., information stored in a database or similar resource). Tracking may facilitate usage economy (e.g., by not discarding or regenerating an article too soon) and improve safety (e.g., by not discarding or regenerating an article after biocidal activity has waned), especially in cases where a color or shade change characteristic of decreasing biocidal activity is not readily observable. By regenerating biocidal activity through reapplying metal nanoparticle agglomerates to an article that otherwise remains servicable, the amount of waste entering landfills may desirably be decreased.

Tracking information received from the identifying tag may be conveyed to a processor in communication with a database or similar resource where usage characteristics are stored. Upon executing appropriate instructions (programming implemented by hardware and/or software), a user may be informed (e.g., through a text message to a mobile device or a similar communication) that the biocidal activity of an article is nearing its expected end and replacement or regeneration is recommended.

Therefore, in some embodiments, the garments, gloves and other personal protective equipment of the present disclosure may be configured for electronic tracking by providing an identifying tag may be associated with a material comprising a touch or contact surface of the garments, gloves or personal protective equipment. The identifying tag may be electronically identifiable, such as radiofrequency identification (RFID) tags, bar codes, QR codes, and any combination thereof. The identifying tag may be visible upon the surface of the garments, glove or personal protective equipment or located within fabric layers and/or on an underside of the glove or personal protective equipment. Alternately, an identifying tag may be sufficiently small that is essentially invisible to the naked eye.

In some embodiments, suitable identifying tags may themselves comprise metal nanoparticles, such as antennas and RFID tags printed with metal nanoparticle inks, as described in U.S. Pat. No. 9,072,185 and U.S. Application Publication 20170252804, each of which is incorporated herein by reference in its entirety. In some embodiments, antennas and RFID tags comprising metal nanoparticles may be printed on a flexible polymer and then encapsulated. The encapsulated antenna or RFID tag may then be applied to a non-touch surface of a glove, such as the backside of the hand, using a decal-type application. In other embodiments, an antenna or RFID tag may be printed directly upon a non-touch surface of a glove or other personal protective equipment and then undergo encapsulation.

Non-visible identifying marks, which may comprise carbon nanotubes, are suitable for use in the disclosure herein and described in more detail in U.S. Pat. No. 9,179,542, which is also incorporated herein by reference in its entirety.

When metal nanoparticles are utilized to provide an identifying tag, the metal nanoparticles within the identifying tag may be the same type of metal nanoparticles or different metal nanoparticles than those used for conveying biocidal activity. For example, metal nanoparticles within an identifying tag may have a different spectroscopic signature, contain a different type of surface functionalization, or the like. The metal nanoparticles defining an identifying tag need not necessarily comprise metal nanoparticle agglomerates, although they may in some instances.

Identifying tags may be interrogated with an electronic reader, examples of which will be familiar to one having ordinary skill in the art, to determine where a user has been wearing the garments, gloves or personal protective equipment, how long the garments, gloves or personal protective equipment have been in service, under what conditions the garments, gloves or personal protective equipment has been worn, or the like. In an extension, a plurality of users may be wearing garments, gloves or personal protective equipment of the present disclosure, each having an identifying tag interrogatable by a reader linked to a central server. The central server may evaluate "hot spots" where users have not been wearing gloves or personal protective equipment and may be subject to infection. Alternately, if an area is known to have experienced an infection (e.g., a known ill individual or a known surface contamination has been identified), users who have entered the hot spot may be identified and instructed to seek medical attention, quarantine, change gloves or personal protective equipment, or the like (e.g., contact tracing). Communication from the central server may also advise when the biocidal activity afforded by metal nanoparticle agglomerates may begin to wane. A smartphone app, for example, may communicate with the central server, and a user may then receive direction from the app regarding appropriate actions to take in various instances. In still another example, the server may identify available workspaces in open concept offices based upon the locations where gloves or other personal protective equipment have been identified and inform an incoming worker accordingly. Communication between the central server and the worker may again take place through a smartphone app or at a terminal after the worker enters their building, in non-limiting examples.

Accordingly, personal protective equipment of the present disclosure, such as gloves, aprons, shoe covers, masks, face shields, socks, and the like, may comprise a material shaped for wear, metal nanoparticle agglomerates adhered to at least a portion of the material, such as upon a surface portion of the material, and an identifying tag associated with the material. Any of the identifying tags and metal nanoparticle agglomerates may be utilized in forming such personal protective equipment. Garments may be similarly marked with an identifying tag.

Garments having metal nanoparticle agglomerates adhered thereto may lessen the likelihood of spreading a pathogen when moving between various areas. For example, adhering metal nanoparticles to the sole of a shoe may limit the likelihood of tracking a contaminant from one area to another. This feature may be beneficial in areas such as schools, day care facilities, doctor's offices, and hospitals where floor contamination may occur routinely.

The garments, gloves and personal protective equipment of the present disclosure may be formed by spraying metal nanoparticles using a suitable spray formulation. Alternately, metal nanoparticle agglomerates may be deposited with a spray formulation, a dip coating formulation, a brush-on formulation, paint, ink, or any combination thereof. The metal nanoparticles may be adhered to a garment, glove or personal protective equipment after being deposited thereon or become adhered at a later time. The metal nanoparticles may remain as individual metal nanoparticles after being adhered to the garment, glove, or personal protective equipment or become at least partially fused to one another. The metal nanoparticle agglomerates may be applied to a textile fabric or polymer film before being formed into an article, such as gloves or other personal protective equipment, or after the article has been formed. Replenishment of the biocidal activity may be realized by reapplying metal nanoparticle agglomerates to a garment, gloves, or personal protective equipment, if the biocidal activity has waned beyond an acceptable degree.

Spray formulations suitable for applying metal nanoparticle agglomerates to a textile fabric or polymer film may comprise an aerosolizable fluid medium, and a plurality of metal nanoparticle agglomerates thereof dispersed in the aerosolizable fluid medium. The aerosolizable fluid medium may be an aerosol propellant (optionally including an organic solvent) or a volatile organic solvent, depending on whether the spray formulations will be sprayed via pumping, gas-pressurization, or dispensed from an aerosol spray vessel, such as an aerosol spray can. Aerosol spray cans may be particularly desirable, since they are in wide use and are easily manufactured and shipped. Aerosol propellants may afford sprayed droplet sizes ranging from about 10-150 microns, whereas mechanically pumped sprays may have a larger droplet size in a range of about 150-400 microns.

Aerosol propellants may be particularly desirable due to their essentially instantaneous evaporation once discharged from their source, such as a spray can. The aerosolized droplets are easily directed to a specified location and do not linger overly long in air before settling on a surface.

Aerosol propellants may be utilized when dispensing the metal nanoparticle agglomerates from a spray can. Any conventional aerosol propellant may be utilized, provided that the metal nanoparticle agglomerates can be effectively dispersed therein and ejected from the spray can. Organic and/or inorganic aerosol propellants may be used. Suitable inorganic aerosol propellants may include, for example, nitrous oxide or carbon dioxide. Suitable organic aerosol propellants may include, for example, volatile hydrocarbons (e.g., ethane, propane, butane, or isobutane), dimethyl ether, ethyl methyl ether, hydrofluorocarbons, hydrofluoroolefins, or any combination thereof. Chlorofluorocarbons and similar compounds may also be used as an aerosol propellant, but their use is not preferred due to their ozone-depleting properties. Nevertheless, chlorofluorocarbons may be satisfactory when other organic aerosolizable fluid media may not be effectively used.

When using an aerosol propellant to promote dispensation of metal nanoparticle agglomerates, the metal nanoparticle agglomerates may be directly combined therewith, or the metal nanoparticle agglomerates may be dissolved in a secondary fluid medium that is subsequently combined with the aerosol propellant in a spray can or similar pressure vessel. Suitable secondary fluid media may comprise organic solvents such as alcohols, glycols, ethers, or the like. Any of the organic solvents specified below as suitable for use in mechanically pumped or forced-pressurization spray formulations may be incorporated in spray formulations containing an aerosol propellant as a secondary fluid medium as well. A fluid dispersion of metal nanoparticle agglomerates within the secondary fluid medium may be combined with an aerosol propellant in a suitable container, such as a spray can. Spray formulations suitable for mechanical dispensation (e.g., using a pump sprayer), described hereinafter, may also utilize one or more organic solvents for dispersing the metal nanoparticle agglomerates into a form suitable for spraying.

Fluid dispersions of metal nanoparticle agglomerates that have not been combined with an aerosol propellant may also be used for deposition of metal nanoparticle agglomerates upon a touch or contact surface. Deposition of metal nanoparticles from a fluid dispersion of metal nanoparticle agglomerates may take place through brushing/painting the fluid dispersion upon the touch or contact surface or by dipping the touch or contact surface in the fluid dispersion.

Spray formulations suitable for dispensation using a pump or gas-pressurization may be prepared by dispersing as-produced or as-isolated metal nanoparticles in an organic medium comprising one or more organic solvents. Suitable organic solvents that may be used in a spray formulation include a $C_1$-$C_{11}$ alcohol, or multiple $C_1$-$C_{11}$ alcohols in any combination. $C_1$-$C_4$ alcohols may be particularly desirable due to their lower boiling points, which may facilitate solvent removal from a surface undergoing disinfection. Additional alcohol-miscible organic solvents may also be present. Ketone and aldehyde organic solvents in the $C_2$-$C_{11}$ size range may also be used, either alone or in combination with one or more alcohols. Ketone and aldehyde solvents are less polar than are alcohols and may aid in promoting dispersion of metal nanoparticle agglomerates. Low boiling ethers such as diethyl ether, dipropyl ether, and diisopropyl ether, for example, may also be suitably used to promote metal nanoparticle agglomerate dispersion. One or more glycol ethers (e.g., diethylene glycol, triethylene glycol, or the like), alkanolamines (e.g., ethanolamine, triethanolamine, or the like), or any combination thereof may also be used alone or in combination with one or more alcohols or any of the other foregoing organic solvents. Various glymes may also be used similarly. Water-miscible organic solvents and mixtures of water and water-miscible organic solvents may be used as well, such as water-organic solvent mixtures comprising up to about 50% water by volume or up to about 75% water by volume. Even up to about 85% water by volume or up to about 90% water by volume may be present in some instances.

In particular examples, the spray formulations can contain one or more alcohols, which may be $C_1$-$C_{11}$, $C_1$-$C_4$, $C_4$-$C_{11}$ or $C_7$-$C_{11}$ in more particular embodiments. $C_1$-$C_4$ alcohols may be particularly desirable due to their lower boiling points, which may facilitate solvent removal following dispensation. In various embodiments, the alcohols can include any of monohydric alcohols, diols, or triols. One or more glycol ethers (e.g., diethylene glycol and triethylene glycol), alkanolamines (e.g., ethanolamine, triethanolamine, and the like), or any combination thereof may be present in certain embodiments, which may be present alone or in combination with other alcohols. Various glymes may be present with the one or more alcohols in some embodiments.

Spray formulations comprising an organic solvent may comprise a mixture of organic solvents that evaporates in a specified period of time, typically under ambient conditions. In non-limiting examples, evaporation may take place in about 1 minute or less, or about 2 minutes or less, or about 5 minutes or less, or about 10 minutes or less, or about 15 minutes or less, or about 30 minutes or less. To facilitate evaporation, the metal nanoparticle agglomerates may be dispersed as a concentrate in a higher boiling organic solvent, such as a $C_{10}$ alcohol, which is then combined with a much larger quantity of low boiling organic solvent, such as ethanol or diethyl ether, optionally in further combination with additional organic solvents. The high boiling organic solvent may be sufficiently hydrophobic to facilitate dispersion of the metal nanoparticles in the less hydrophobic organic solvent comprising the majority of the organic phase.

Any of the foregoing organic solvents or mixtures thereof, including water-organic solvent mixtures, may also be utilized to disperse metal nanoparticle agglomerates as a concentrate for combination with an aerosol propellant.

The spray formulations may exhibit a viscosity value of about 1 cP to about 500 cP, including about 1 cP to about 100 cP. Low viscosity values such as these may facilitate dispensation through spraying promoted by mechanical pumping or gas-pressurization. Metal nanoparticle loadings within the spray formulations to produce the foregoing viscosity values may range from about 0.5 wt. % to about 35 wt. %, or about 1 wt. % to about 35 wt. %, or about 10 wt. % to about 25 wt. %, or about 0.5 wt. % to about 5 wt. %, or about 1 wt. % to about 10 wt. %, or about 10 wt. % to about 15 wt. %. Liquid dispersions suitable for painting/brushing or dip coating may contain metal nanoparticle agglomerates in similar concentration ranges.

Dip coating formulations may also be suitable for use in dispersing nanoparticle agglomerates and applying the metal nanoparticle agglomerates to a surface in need of infection control. Once dispersed, a fabric may be continuously drawn through the dip coating formulation (e.g., in a roll-to-roll processing line) and then dried to facilitate metal nanoparticle agglomerate adhesion to the fabric. Such roll-to-roll processing may facilitate low-cost, mass market production of garments, gloves and other types of personal protective equipment having metal nanoparticle agglomerates adhered thereto. In addition, suitable dip coating formulations may be provided for at-home or batch use for application to existing gloves otherwise not having metal nanoparticle agglomerates adhered thereto. The metal nanoparticle agglomerate concentration in the fluid medium may dictate the loading upon the fabric. Multiple dip coating and drying operations may be utilized to afford a loading of about 0.03 $mg/in^2$ to about 10 $mg/in^2$ of fabric, such as loadings of about 0.03 $mg/in^2$ to about 0.1 $mg/in^2$, or about 0.1 $mg/in^2$ to about 0.7 $mg/in^2$, or about 0.7 $mg/in^2$ to about 1.5 $mg/in^2$, or about 1.5 $mg/in^2$ to about 2 $mg/in^2$, or about 2 $mg/in^2$ to about 3 $mg/in^2$, or about 3 $mg/in^2$ to about 10 $mg/in^2$. Brush-on techniques may also be suitably used to apply the metal nanoparticle agglomerates to the fibers of a fabric or to a polymer film, wherein similar fabric loadings may be achieved.

The metal nanoparticles used in the spray formulations, dip coating formulations, and similar formulations disclosed herein can be about 20 nm or more in size. The metal nanoparticles within the metal nanoparticle agglomerates utilized herein can be about 20 nm or more in size, particularly about 50 nm or more in size. In suitable examples, all or at least about 90%, at least about 95%, or at least about 99% of the metal nanoparticles within the metal nanoparticle agglomerates may be about 20 nm to about 200 nm in size or about 50 nm to about 250 nm in size. Smaller copper nanoparticles (under 20 nm) may tend to undergo more extensive oxidation into CuO or $Cu_2O$ than do larger copper nanoparticles having a size above 20 nm. In the presence of moisture, formation of other salt compounds may be more prevalent for smaller copper nanoparticles like these. Copper nanoparticles in the foregoing size range (20 nm or above) may afford a mixture of CuO or $Cu_2O$, or a copper salt depending on use conditions, upon a copper metal core, the combination of which may be advantageous for inactivating pathogens upon a surface once applied thereto. Silver nanoparticles in a similar size range may form an advantageous silver oxide coating when processed according to the disclosure herein to promote adherence to a surface. When the copper nanoparticles and/or silver nanoparticles are agglomerated together upon a surface, the oxide coating may extend over at least a portion of the surface of the agglomerate, leaving an exposed copper or silver metal surface below within the porosity of the agglomerate. The oxide(s) in combination with unconverted metal may offer complementary biocidal activity for promoting disinfection according to the disclosure herein, including release of oxidized metal from the metal nanoparticle agglomerates on a time-release basis. By having larger metal nanoparticles in the foregoing size range, a substantial amount of zero-valent metal may be retained for promoting biocidal activity in combination with at least some oxide, whereas smaller metal nanoparticles may form too much oxide to promote optimal biocidal activity. Metal nanoparticle loadings upon a touch surface of an article may range from about 0.5 wt. % to about 5 wt. % based on total weight.

Copper nanoparticles that are about 20 nm or less in size can also be used in the disclosure herein, optionally in combination with larger copper nanoparticles (20 nm or more in size). Copper nanoparticles in this size range have a fusion temperature of about 220° C. or below (e.g., a fusion temperature in the range of about 140° C. to about 220° C.) or about 200° C. or below, or even about 175° C. or below, which can provide advantages noted above. Silver nanoparticles about 20 nm or less in size may also be used in the disclosure herein and similarly exhibit a fusion temperature differing significantly from that of the corresponding bulk metal. Larger metal nanoparticles (either copper or silver nanoparticles), in turn, have a higher fusion temperature, which may rapidly increase and approach that of bulk metal as the nanoparticle size continues to increase. Depending on the processing temperature and the fusion temperature of the copper nanoparticles and/or silver nanoparticles based upon their size, the metal nanoparticles may or may not be fused upon a touch surface when sprayed thereon according to the disclosure herein. Regardless of whether the nanoparticles become fused or not once deposited upon a touch surface, after the surfactant coating is removed, the copper nanoparticles and/or silver nanoparticles may experience robust adherence to the touch surface and become effective for inactivating various pathogens.

As-produced copper nanoparticles and silver nanoparticles are usually produced in the form of agglomerates which need to be broken apart into individual surfactant-coated metal nanoparticles in order to promote use in various applications. Surprisingly, as-produced agglomerates, such as those residing in a 0.5-5 micron size range (500 nm-5 micron size range) or even larger, can be effective for spray, painting, or dip coating dispensation and retention upon a touch or contact surface or garments, gloves, or personal protective equipment. Agglomerates of these sizes, and even larger, may be more effectively retained upon a surface than are individual metal nanoparticles or smaller agglomerates. Within the agglomerates, recognizable sub-structures may be present prior to nanoparticle fusion such as, but not limited to, 10-50 nm thick platelets, 100-250 nm wide spheres, metal nanowires, the like, or any combination thereof. Copper nanoparticles and/or silver nanoparticles may also be combined with pre-made nanowires (e.g., copper nanowires or silver nanowires) in a suitable spray formulation for deposition upon a surface as well. The sub-structures may have any shape such as square, triangular, rectangular, multi-faceted, round, and ovular, and crystalline, and/or non-crystalline morphologies. Elongate structures, such as metal nanowires, may have an aspect ratio of at least about 10 or at least about 25, for example. Copper nanoparticles and/or silver nanoparticles may also be combined with pre-made nanowires (e.g., copper nanowires or silver nanowires) and deposited upon a surface as well. Zinc, nickel, or titanium, particularly in the form of nanoparticles or a metal oxide form thereof, may be present in any of these embodiments as well.

In addition to copper nanoparticles, silver nanoparticles, or alternative nanostructures, other additives may be incorporated within spray formulations or other formulations suitable for use in the disclosure herein. Suitable additives may include, but are not limited to, those capable of producing reactive oxygen species (ROS), which may cause lipid, protein, or DNA damage in microorganisms, eventually leading to cell membrane damage and cell death. These additives may complement or enhance the biocidal activity conveyed by copper nanoparticles, silver nanoparticles, or alternative metal nanoparticles having biocidal activity, such as those comprising zinc. Conventional disinfectant compounds may be included in the spray formulations or similar formulations as well, examples of which will be familiar to one having ordinary skill in the art. Additional details directed to a non-limiting mechanism by which metal nanoparticles are believed to provide biocidal activity are provided above. Added metal salt compounds, or surfactant-stabilized forms thereof, may also be present in formulations suitable for depositing metal nanoparticle agglomerates upon a fabric or polymer film, such as in a glove or personal protective equipment.

NiO may be included as an additive within the spray formulations in addition to metal nanoparticles. NiO is very efficient in producing ROS when present in small concentrations. NiO may be effective when included at, for example, about 0.5% to about 10% of the load of copper nanoparticles and/or silver nanoparticles in the spray formulations (e.g., 0.5 mg to 100 mg NiO) as sub-micron particles separate and distinct from the copper nanoparticles and/or silver nanoparticles. At these loadings, NiO is very effective against certain bacteria, which may broaden the biocidal effectiveness of copper or silver. Bismuth, zinc, and tin oxides may be similarly effective at loadings of about 0.5% to about 10% of the mass of copper nanoparticles.

$TiO_2$ may be included within spray formulations in addition to metal nanoparticles. $TiO_2$ may catalyze the formation of hydroxyl radicals upon UV irradiation (e.g., in sunlight) when a protective covering of the present disclosure is located outdoors, for example. Atmospheric moisture may supply the source of water for producing the hydroxyl radicals by photooxidation. $TiO_2$ may be present at about 1% to about 25% of the load of copper nanoparticles and/or silver nanoparticles in the spray formulations. The $TiO_2$ may likewise be present in the form of nanoparticles and/or micron-size particles (e.g., about 100 nm to about 5 microns). Both anatase and rutile forms of $TiO_2$, or mixtures thereof, may be used, although the anatase form is usually more photocatalytically active.

Copper nanoparticles and/or silver nanoparticles, and NiO and/or $TiO_2$ may also be used in any combination with one another within spray formulations as well.

As discussed above, metal nanoparticles and agglomerates thereof may exhibit adherence to a variety of surfaces, such as through van der Waals adhesion and electrostatic interactions, which may be further supplemented through the high surface energy of the metal nanoparticles. In addition to metal nanoparticles, the spray formulations or other formulations disclosed herein may further comprise an adhesive that is suitable for promoting metal nanoparticle agglomerate adherence to a given surface. Suitable adhesives for promoting adherence of metal nanoparticles to a touch surface will be familiar to one having ordinary skill in the art and may include conventional epoxy adhesives, nitrile rubber adhesives, acrylic adhesives, styrene-acrylic adhesives, cyanoacrylate adhesives, solvent-based adhesives, aqueous emulsions, and the like. The adhesive may be applied to a touch or contact surface separately from metal nanoparticle agglomerates, or be present in the spray formulations or other coating formulations in which metal nanoparticle agglomerates are present and in an amount sufficient to promote uniform application upon a fabric, such as at a loading of 0.1 $mg/in^2$ to about 0.5 $mg/in^2$.

Particularly suitable adhesives may be biologically compatible adhesives such as octyl cyanoacrylate, 2-octyl cyanoacrylate, butyl cyanoacrylate, and isobutyl cyanoacrylate. Other examples of suitable adhesives having biocompatibility include, for example, polydioxanone, polyglycolic acid, polylactic acid, and polyglyconate. MAXON, a polyglycolide-trimethylene carbonate used a biodegradable suture adhesive, may represent a particular example. Suitable loadings of the adhesive in the spray formulations and similar formulations may range from about 0.35 g adhesive/100 g spray formulation to about 2.75 g adhesive/100 g spray formulation. Coverage of the adhesive upon a touch or contact surface of a garment, glove, or personal protective equipment may range from about 50% to about 100% by area, or about 60% to about 90% by area, or about 75% to about 95% by area, or about 90% to about 99% by area. A layer thickness of the adhesive upon the touch or contact surface may be about 100 nm or less or about 50 nm or less, such as about 1 nm to about 2 nm, or about 2 nm to about 5 nm, or about 5 nm to about 10 nm, or about 10 nm to about 50 nm. In addition to promoting surface adherence, the adhesive may slow down oxidation, thereby affording a time-release profile of an active metal species. An adhesive may be suitably incorporated in dip coating and brush-on formulations as well.

When applying an adhesive to the surface of a textile fabric or polymer film along with metal nanoparticle agglomerates, the adhesive may be present in the formulation applied to the textile fabric or polymer film, or a formulation comprising an adhesive and a formulation comprising metal nanoparticle agglomerates may be applied separately, such as through spraying. The adhesive formulation may be sprayed upon the textile fabric or polymer film first, followed by the spray formulation comprising metal nanoparticle agglomerates, or the adhesive formulation and the metal nanoparticles may be sprayed concurrently. When used, the adhesive may further facilitate time-release of metal nanoparticles from metal nanoparticle agglomerates.

After depositing metal nanoparticle agglomerates upon a touch or contact surface (e.g., by spraying, painting, rolling, stenciling, dip-coating, or the like), the coverage of metal nanoparticles upon the surface may range from about 5% to about 75% by area or any other suitable ranges disclosed therein. Thereafter, removal of the solvent and surfactants may take place, either at room temperature and atmospheric pressure, or with heating and optional application of vacuum. Solvent evaporation may take place in conjunction with metal nanoparticle agglomerate deposition if the aerosolizable fluid medium is sufficiently volatile. Alternately, the aerosolizable fluid medium may be removed after metal nanoparticle agglomerate deposition takes place. If tolerable to a textile fabric or polymer film, nanoparticle fusion (if occurring) and/or solvent removal may be accelerated by one or more of heating and application of vacuum. Heating may take place at any temperature from room temperature up to or beyond the fusion temperature of the metal nanoparticles, provided that the heating temperature is not so high that thermal damage occurs. Thus, the metal nanoparticles within the metal nanoparticle agglomerates may be fused or unfused when adhered to a textile fabric or polymer film or similar touch or contact surface. Moreover, the heating temperature need not necessarily exceed the normal boiling point or reduced pressure boiling point of the surfactants and solvent in order to promote their removal. Gentle heating well below the boiling point of the surfactant and solvent may be sufficient to promote their removal in some instances. In non-limiting embodiments, the heating may be conducted under flowing nitrogen or air or under vacuum to promote surfactant removal. Room temperature removal of organic solvents and/or surfactants may also be conducted. For example, heating may take place at a temperature of about 35° C. to about 65° C. in flowing nitrogen or air to promote removal of solvent and surfactant, thereby leaving unfused metal nanoparticles distributed upon the textile fabric or polymer film. Additional heating may be conducted thereafter, if desired, to promote metal nanoparticle fusion. In either case, after the surfactants are removed from the nanoparticle surface, robust adherence to the textile fabric or polymer film may be realized. When heating under higher temperatures, use of an inert atmosphere, such as nitrogen, may be desirable to limit substrate degradation and to control the amount of surface oxidation taking place upon the metal nanoparticles.

Once the surfactant has been removed from the metal nanoparticles (e.g., copper nanoparticles and/or silver nanoparticles or agglomerates thereof), the metal nanoparticles may undergo at least partial oxidation to form an oxide coating. The size of copper nanoparticles or agglomerates thereof may be selected such that at least some copper metal remains following oxidation, since a mixture of copper metal and oxidized copper may be beneficial for conveying antiseptic activity by inactivating one or more pathogens. Silver nanoparticles may similarly experience different amounts of surface oxidation depending upon the size of the silver nanoparticles and how they are processed. In non-limiting embodiments, following surfactant removal, copper nanoparticles may form a reaction product comprising about 25% to about 99% metallic copper by weight, about 0.5% to about 60% $Cu_2O$ by weight, and about 0.1% to about 20% CuO by weight. In more particular embodiments, the amount of metallic copper may be about 45% to about 90% by weight, or about 50% to about 70% by weight, or about 80% to about 98% by weight, and the amount of $Cu_2O$ may be about 10% by weight or less, such as about 0.1% to about 10% by weight or less or about 5% to about 10% by weight or less, and the amount of CuO may be about 1% by weight or less, such as about 0.1% to about 1% by weight or about 0.5% to about 1% by weight. The $Cu_2O$ and CuO may form a shell or partial shell upon the metal nanoparticles or agglomerates thereof that is about 1 nm or greater, or about 10 nm or greater in thickness, or even about 100 nm or greater in thickness, such as about 10 nm to about 100 nm thick in many instances.

Silver nanoparticles adhered to the touch surface of gloves or other personal protective equipment may similarly comprise about 25% to about 99% metallic silver by weight and the balance being $Ag_2O$. The $Ag_2O$ may similarly be present in a shell having a thickness of about 10 nm or greater, such as about 100 nm to about 3 microns thick.

More specific examples of techniques suitable for applying metal nanoparticle agglomerates to fabrics and polymer films, particularly by dip coating or direct contacting techniques, may include, for example, knife-over-edge coating, slot-die coating, direct gravure coating, micro-gravure coating, flood coating, and the like. Such processes may take place in a continuous roll-to-roll manner. Details concerning these techniques will be familiar to one having ordinary skill in the art. Likewise, direct spray coating may be utilized to produce a fabric or polymer film comprising metal nanoparticle agglomerates in any embodiment of the present disclosure. Accordingly, the present disclosure further provides fabrics or polymer films comprising metal nanoparticle agglomerates adhered thereto. Tracking of fabrics or polymer films using an identifying tag is also within the scope of the present disclosure.

Once a fabric or polymer film has been obtained, a glove or garment comprising metal nanoparticle agglomerates may be prepared by stitching the fabric or polymer film with a fabric or polymer film lacking metal nanoparticle agglomerates. That is, the fabric or polymer film comprising metal nanoparticle agglomerates may comprise one or more touch surfaces of a glove, and a conventional fabric or polymer film lacking metal nanoparticles may comprise a non-touch surface of the glove. The fabric or polymer film comprising the touch surface of the glove may have metal nanoparticle agglomerates upon at least an outside surface of the fabric or polymer film (i.e., the touch surface) and optionally an inner surface of the fabric or polymer film configured to contact a wearer's palm and fingertips. Alternately, a fabric or polymer film comprising adhered metal nanoparticle agglomerates may be employed to form the entirety of a glove or similar personal protective equipment. Still further alternately, a glove or other personal protective equipment may be fabricated from a fabric or polymer film lacking metal nanoparticle agglomerates, and metal nanoparticle agglomerates may be applied to the glove or other personal protective equipment by spray-on or dip-coating techniques, for example. Again, at least a touch surface of the glove or other personal protective equipment may comprise metal nanoparticle agglomerates, and at least a majority of the outer surface of the glove may comprise metal nanoparticle agglomerates in some cases. Gloves comprising a polymer may be produced by forming the polymer around a mold, and then applying metal nanoparticle agglomerates to at least an outer surface of the glove. Gloves or other articles that have lost their biocidal activity following metal nanoparticle oxidation may have their biocidal activity regenerated through reapplying fresh nanoparticle agglomerates thereto, such as through applying a spray formulation.

Embodiments disclosed herein include:

A. Gloves having an antiseptic touch surface. The gloves comprise: a body having one or more touch surfaces when worn; and metal nanoparticle agglomerates adhered to a material defining the one or more touch surfaces.

B. Personal protective equipment having an antiseptic touch surface and electronic tracking capabilities. The personal protective equipment comprises: a material shaped for wear; metal nanoparticle agglomerates adhered to at least a portion of a surface of the material; and an identifying tag associated with the material.

C. Fabrics. The fabrics comprise a plurality of fibers; and metal nanoparticle agglomerates adhered to the fibers.

D. Polymer films. The polymer films comprise a polymer; and metal nanoparticle agglomerates adhered to a surface of the polymer.

Each of embodiments A-D may have one or more of the following additional elements in any combination:

Element 1: wherein the one or more touch surfaces comprise a palm portion of the glove, a finger portion of the glove, or any combination thereof.

Element 2: wherein the body comprises a material selected from polymer fibers, textile fibers, a polymer film, and any combination thereof.

Element 3: wherein the body further comprises one or more non-touch surfaces contiguous with the one or more touch surfaces.

Element 4: wherein at least a portion of the one or more non-touch surfaces lack metal nanoparticle agglomerates.

Element 5: wherein metal nanoparticle agglomerates are adhered to at least a portion of the one or more non-touch surfaces.

Element 6: wherein the glove further comprises an adhesive located upon the one or more touch surfaces, the adhesive promoting adherence of the metal nanoparticle agglomerates to the material.

Element 7: wherein the glove further comprises an identifying tag associated with the material.

Element 8A: wherein the identifying tag is electronically identifiable.

Element 8B: wherein the identifying tag is selected from the group consisting of a radiofrequency identification (RFID) tag, a bar code, a QR code, and any combination thereof.

Element 9: wherein the metal nanoparticle agglomerates comprise copper nanoparticles, silver nanoparticles, or any combination thereof.

Element 10: wherein the metal nanoparticle agglomerates cover about 5% to about 95% of the one or more touch surfaces by area and at a coverage of about 1 mg/in$^2$ to about 2 mg/in$^2$.

Element 11: wherein the personal protective equipment comprises a glove, a gown, a shoe, a mask, a face shield, or a protective covering.

Element 12: wherein the personal protective equipment further comprises an adhesive located upon the surface of the material, the adhesive promoting adherence of the metal nanoparticle agglomerates to the material.

Element 13: wherein the gloves or personal protective equipment further comprises a metal salt compound admixed with the metal nanoparticle agglomerates.

By way of non-limiting example, exemplary combinations applicable to A, but are not limited to: 1 and 2; 1, 2 and 7; 1, 3 and 4; 1, 3, 4 and 7; 1, 3 and 5; 1, 3, 5 and 7; 1 and 6; 1, 6 and 7; 1 and 7; 1, 7, and 8A or 8B; 1 and 9; 1, 7 and 9; 1 and 10; 1, 7 and 10; 2-4; 2-4 and 7; 2, 3, and 5; 2 and 6; 2, 6 and 7; 2 and 7; 2, 7, and 8A or 8B; 2 and 9; 2, 7 and 9; 2 and 10; 2, 7 and 10; 3, 4 and 6; 3, 4, 6 and 7; 3, 5 and 6; 3, 5, 6 and 7; 3, 4, 7, and 8A or 8B; 3, 5, 7, and 8A or 8B; 3, 4, 7 and 9; 3, 5, 7 and 9; 3, 4 and 10; 3, 4, 7 and 10; 3, 5 and 10; 3, 5, 7 and 10; 6 and 7; 6, 7, and 8A or 8B; 6, 7 and 9; 6 and 9; 6 and 10; 6, 7 and 10; 7 and 9; 7, 8A or 8B, and 9; 7 and 10; and 9 and 10, any of which may be in further combination with element 13.

By way of further non-limiting example, exemplary combinations applicable to B, but are not limited to: 8A or 8B, and 9; 8A or 8B, and 10; 8A or 8B, and 11; 8A or 8B, and 12; 9 and 10; 9 and 11; 9 and 12; 10 and 11; 10 and 12; 8A or 8B, 11 and 12; and 10-12, any of which may be in further combination with element 13.

Additional embodiments disclosed herein include:

A1. Gloves having a biocidal surface. The gloves comprise: a body having one or more touch surfaces when worn; and metal nanoparticle agglomerates adhered to a material defining the one or more touch surfaces.

B1. Garments having a biocidal surface. The garments comprise: a touch or contact surface defined by a material having metal nanoparticle agglomerates adhered thereto.

C1. Fabrics having a biocidal surface. The fabrics comprise: a plurality of fibers; and metal nanoparticle agglomerates adhered to the fibers.

D1. Polymer films having a biocidal surface. The polymer films comprise: a polymer; and metal nanoparticle agglomerates adhered to the polymer.

E1. Personal protective equipment having a biocidal surface. The personal protective equipment comprises: a material having metal nanoparticle agglomerates adhered thereto, the material being shaped for wear; and an identifying tag associated with the material, the identifying tag being electronically identifiable.

Each of embodiments A1-E1 may have one or more of the following additional elements in any combination:

Element 1': wherein the one or more touch surfaces comprise a palm portion of the glove, a finger portion of the glove, or any combination thereof.

Element 2': wherein the body comprises a material selected from the group consisting of polymer fibers, textile fibers, a polymer film, and any combination thereof.

Element 2A': wherein the material comprises a polymer, a textile, or any combination thereof.

Element 3': wherein the body further comprises one or more additional surfaces contiguous with the one or more touch surfaces.

Element 4': wherein at least a portion of the one or more additional surfaces are substantially free of metal nanoparticle agglomerates.

Element 5': wherein metal nanoparticle agglomerates are also adhered to at least a portion of the one or more additional surfaces.

Element 6': wherein the metal nanoparticle agglomerates are adhered to the material via an adhesive layer.

Element 7': wherein the glove further comprises an identifying tag associated with the material, the identifying tag being electronically identifiable.

Element 7A': wherein the garment, fabric or polymer film further comprises an identifying tag associated therewith, the identifying tag being electronically identifiable.

Element 8': wherein the identifying tag is selected from the group consisting of a radiofrequency identification (RFID) tag, a bar code, a QR code, and any combination thereof.

Element 9': wherein the metal nanoparticle agglomerates comprise copper nanoparticles, silver nanoparticles, or any combination thereof.

Element 10': wherein the metal nanoparticle agglomerates comprise metal nanoparticles, in which at least a majority of the metal nanoparticles range from about 50 nm to about 250 nm in size.

Element 11': wherein the metal nanoparticle agglomerates range from about 1 micron to about 35 microns in size.

Element 12': wherein the metal nanoparticle agglomerates cover about 5% to about 95% of the one or more touch surfaces by area and at a coverage density of about 0.4 mg/in$^2$ to about 5 mg/in$^2$.

Element 12A': wherein the metal nanoparticle agglomerates are adhered to the material at a coverage density of about 0.4 mg/in$^2$ to about 5 mg/in$^2$.

Element 13': wherein the touch or contact surface is subject to infection when the garment is worn.

Element 14': wherein the personal protective equipment comprises a glove, a gown, a shoe, a mask, or a face shield.

By way of non-limiting example, exemplary combinations applicable to A1 include, but are not limited to: 1' and 2'; 1' and 3'; 1', 3' and 4'; 1', 3' and 5'; 1' and 6'; 1' and 7'; 1', 7' and 8'; 1' and 9'; 1' and 10'; 1', 9' and 10'; 1', 9' and 11'; 1' and 12'; 2' and 3'; 2', 3' and 4'; 2', 3' and 5'; 2' and 6'; 2', 7' and 8'; 2' and 9'; 2', 9' and 10'; 2' and 11'; 2', 9' and 11'; 2' and 12; 6' and 7'; 6', 7' and 8'; 6' and 9'; 6' and 10'; 6', 9' and 10'; 6' and 11'; 6', 9' and 11'; 6' and 12'; 7' and 8'; 7' and 9'; 7', 9' and 10'; 7' and 11'; 7', 9' and 11'; 7', 8' and 9'; 7', 8', 9' and 10'; 7', 8' and 11'; 7', 8', 9' and 11'; 7' and 12'; 9' and 10'; 9' and 11'; 9', 10' and 11'; 9' and 12'; 10' and 11'; 10' and 12'; and 11' and 12'. Additional exemplary combinations applicable to B1-E1 include, but are not limited to, 2A' and 6'; 2A' and 8A'; 2A' and 9'; 2A' and 10; 2A', 9' and 10'; 2A' and 11'; 2A', 9' and 11'; 2A' and 12A'; 2A' and 13'; 6' and 8A'; 6' and 9'; 6', 9' and 10'; 6' and 11'; 6', 9' and 11'; 6' and 12A'; 6' and 13'; 8A' and 9; 8A' and 10'; 8A', 9' and 10'; 8A' and 11'; 8A', 10' and 11'; 8A' and 12A'; 8A' and 13'; 9' and 10';

9' and 11'; 9', 10' and 11'; 9' and 12A'; 9' and 13'; 10' and 11'; 10' and 12A'; 10' and 13'; 11' and 12A'; 11' and 13'; and 12A' and 13'.

To facilitate a better understanding of the present disclosure, the following examples of preferred or representative embodiments are given. In no way should the following examples be read to limit, or to define, the scope of the invention.

EXAMPLES

Figure 10:
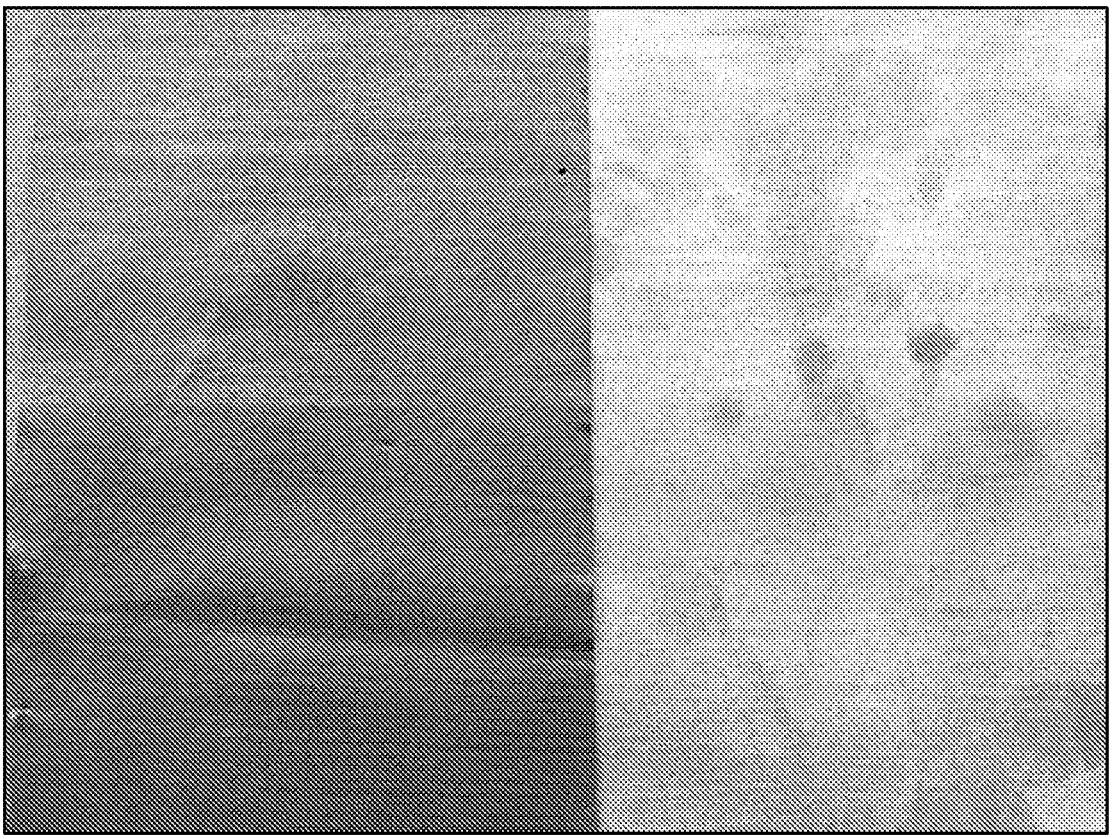
FIG. 10 shows an illustrative photographic image of a fabric having agglomerates of copper nanoparticles adhered thereto, as fabricated (left side of image) and after extended use (right side of image).

Agglomerates of copper nanoparticles in the 50-250 nm size range with a monolayer of amine surfactants on their surfaces and having an agglomerate size of 1-35 microns were adhered to a 55/45 cellulose/polyester fabric blend with an average fiber diameter of about 10 microns using an epoxy adhesive. This may be done via spray coating a suitable ink or dye formulation onto the fibers, or dip coating or gravure coating via a commercial process. The adhesive layer was about 20-50 nm thick, and the metal nanoparticle agglomerates were partially embedded in the adhesive layer with a substantial portion still exposed. The areal coverage of the agglomerates upon the fiber surfaces was about 20-50%. The copper loading upon the fabric ranged from about 1.2 mg/in$^2$ to about 2.7 mg/in$^2$. Depending on size, some of the agglomerates may have the surfactant layer partially removed, thereby resulting in partial oxidation and an overall mixture of copper metal, $Cu_2O$ and CuO species on the fiber surface. The copper metal to oxide ratio may reside in the 1-10% range. Over time, oxidation and dissolution progressively result in fading of the initial dark brown-red color to more light yellow-green. FIG. 10 shows an illustrative photographic image of a fabric having agglomerates of copper nanoparticles adhered thereto, as fabricated (left side of image) and after extended use (right side of image). The nanoparticle-loaded fabric was then subjected to various stability and toxicological tests specified below.

Agglomerates of copper nanoparticles in the 20-150 nm size range with a partially removed monolayer of amine surfactants on their surfaces and having an agglomerate size of 5-15 microns were adhered to a 30/70 cellulose/polyester fabric blend with an average fiber diameter of about 10 microns using an epoxy adhesive. This may be done via spray coating a suitable ink or dye formulation onto the fibers, or dip coating or gravure coating via a commercial process. The adhesive layer was about 50-100 nm thick and the metal nanoparticle agglomerates were partially embedded in the adhesive layer with a substantial portion still exposed. The areal coverage of the agglomerates upon the fiber surfaces was about 30-70%. The copper loading upon the fabric ranged from about 2.3 mg/in$^2$ to about 4.5 mg/in$^2$. Depending on size, some of the agglomerates may be fully or partially oxidized, thereby resulting in an overall mixture of copper metal, $Cu_2O$ and CuO species on the fiber surface. The copper metal to oxide ratio may reside in the 5-25% range.

Agglomerates of copper nanoparticles in the 50-250 nm size range with a monolayer of amine surfactants on their surfaces and having an agglomerate size of 1-35 microns were adhered to a 55/45 cellulose/polyester fabric blend with an average fiber diameter of about 10 microns using a styrene acrylic acid block copolymer adhesive. This may be done via spray coating a suitable ink or dye formulation onto the fibers, or dip coating or gravure coating via a commercial process. The adhesive layer was about 100-250 nm thick, and the metal nanoparticle agglomerates were partially embedded in the adhesive layer with a substantial portion still exposed. The areal coverage of the agglomerates upon the fiber surfaces was about 10-35%. The copper loading upon the fabric ranged from about 1.7 mg/in$^2$ to about 3.5 mg/in$^2$. Depending on size, some of the agglomerates may be fully or partially oxidized, thereby resulting in an overall mixture of copper metal, $Cu_2O$ and CuO species on the fiber fabric surface. The copper metal to oxide ratio may reside in the 5-15% range.

Agglomerates of copper nanoparticles in the 50-200 nm size range with a monolayer of amine surfactants on their surfaces and having an agglomerate size of 1-35 microns were adhered to a 100% polypropylene fabric (melt-blown) with an average fiber diameter of about 10 microns using an epoxy adhesive. This may be done via spray coating a suitable ink or dye formulation onto the fibers, or dip coating or gravure coating via a commercial process. The adhesive layer was about 35-150 nm thick, and the metal nanoparticle agglomerates were partially embedded in the adhesive layer with a substantial portion still exposed. The areal coverage of the agglomerates on the fiber surfaces was about 5-30%. The copper loading upon the fabric ranged from about 0.7 mg/in$^2$ to about 1.6 mg/in$^2$. Depending on size, some of the agglomerates may be fully or partially oxidized, thereby resulting in an overall mixture of copper metal, $Cu_2O$ and CuO species on the fiber surface. The copper metal to oxide ratio may reside in the 1-5% range.

Agglomerates of copper nanoparticles in the 35-200 nm size range with a monolayer of amine surfactants on their surfaces and having an agglomerate size of 3-25 microns were adhered to a 100% cotton fabric with an average fiber diameter of about 10 microns using a styrene acrylic acid block copolymer adhesive. This may be done via spray coating a suitable ink or dye formulation onto the fibers, or dip coating or gravure coating via a commercial process. The adhesive layer was about 50-150 nm thick, and the metal nanoparticle agglomerates were partially embedded in the adhesive layer with a substantial portion still exposed. The areal coverage of the agglomerates upon the fiber surfaces was about 40-75%. The copper loading upon the fabric ranged from about 2.7 mg/in$^2$ to about 4.5 mg/in$^2$. Depending on size, some of the agglomerates may be fully or partially oxidized, thereby resulting in an overall mixture of copper metal, $Cu_2O$ and CuO species on the fiber surface. The copper metal to oxide ratio may be in the 3-25% range.

When the foregoing fabrics were utilized as dry wipes for disinfection of a hard surface, wiping the hard surface for just 5 seconds may result in full sterilization of a wide range of microbes, viruses and bacteria. Depending on the frequency of use, such dry wipes may remain effective for up to about 30 days. After use, the dry wipes may self-sterilize (e.g., in about 5 minutes or less) for frequent and rapid reuse. Since the pathogens are killed or inactivated upon contact, transfer and cross-contamination is unlikely to occur.

Stability testing. A 6"×6" sheet of fabric was tumbled in water for 8 hours. Only 1.4% of the available copper by weight (0.54 mg) was released into the water.

Shedding was also determined by exposing the fabric to simulated breathing conditions (8.4 and 40.8 m/min face velocity gas flow) and analyzing a filter trap for liberated copper by SEM or EDS. The shedding tests did not reveal detectable liberation of copper from the fabric.

VOCs. No volatile organic compounds (VOCs) from a battery of 70 standard VOCs were detected as being released from the fabric when tested under standard conditions.

Direct exposure to cell growth media. A piece of fabric was first soaked in supplemented cell growth media for up to an hour and then removed. Thereafter, Vero cells or Calu-3 lung epithelial cells were immersed in the cell growth media and incubated overnight in a $CO_2$ incubator. Cell viability was determined by assessing ATP production using a luminescence assy. The luminescence assay did not reveal a substantial change in cell viability.

Efficacy. Efficacy of the fabric against a panel of bacterial and viral pathogens was tested. The panel included gram-positive, gram-negative, and antibiotic-resistant bacteria, bacteriophages as representatives of non-enveloped viruses, enveloped viruses such as H1N1 flu, H3N2 flu, and SARS-CoV-2, and non-enveloped viruses such as feline calicivirus. In all cases, >99% kill rates were observed within 30 seconds, and full efficacy was maintained over 15 days of repeated daily exposure. The efficacy was >99.9% over a standard EPA exposure time of 2 hours against *Staphylococcus aureus* (ATCC 6538), *Enterobacter aerogenes* (ATCC 13048), *Pseudomonas aeruginosa* (ATCC 15442), Methicillin Resistant *Staphylococcus aureus* MRSA (ATCC 33592), and *Escherichia coli* O157:H7 (ATCC 35150). The fabric maintained substantially 100% of the original efficacy against repeated viral inocculations (27M PFUs; H1N1, H3N2 and feline calicivirus) or bacterial loads introduced to the fabric over the course of 30 days. The fabric maintained >99.9% efficacy against *Staphylococcus aureus* and *Klebsiella aerogenes* after months of daily high-touch use and moisture exposure with visible wear. An inactivation rate of substantially 100% was realized against human wound pathogens such as *Acinetobacter baumannii, Klebsiella pneumonia, Pseudomonas aeruginosa, Enterococcus faecalis*, Methicillin-resistant *Staphylococcus aureus* (MRSA), and *Staphylococcus epidermidis* over 24 hours.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the features of the present disclosure are presented herein. Not all features of a physical implementation are described or shown in this application for the sake of clarity. It is understood that in the development of a physical embodiment incorporating the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The disclosure herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. Personal protective equipment comprising:
a touch or contact surface defined by a material;
the material being shaped for wear;
metal nanoparticle agglomerates adhered to the material; and
an identifying tag associated with the material the identifying tag being electronically identifiable;
wherein the metal nanoparticle agglomerates comprise metal nanoparticles; and
wherein at least a majority of the metal nanoparticles range from about 50 nm to about 250 nm in size,
wherein the metal nanoparticles agglomerates cover about 5% to about 95% of the material by area and at a coverage density of about 0.4 mg/in$^2$ to about 5 mg/in$^2$.

2. The personal protective equipment of claim 1, wherein the identifying tag is selected from the group consisting of a radiofrequency identification (RFID) tag, a bar code, a QR code, and any combination thereof.

3. The personal protective equipment of claim 1, wherein the metal nanoparticle agglomerates comprise copper nanoparticles, silver nanoparticles, zinc nanoparticles, nickel nanoparticles, titanium nanoparticles, or any combination thereof.

4. The personal protective equipment of claim 1, wherein the personal protective equipment comprises a glove, a gown, a shoe, a mask, or a face shield.

5. The personal protective equipment of claim 1, wherein the metal nanoparticles agglomerates are adhered to the material via an adhesive layer.

6. The personal protective equipment of claim 1, wherein the metal nanoparticles agglomerates range from about 1 micron to about 35 microns in size.

7. The personal protective equipment of claim 1, wherein the material changes color as oxidation and/or breakup of the metal nanoparticle agglomerates occurs.

8. The personal protective equipment of claim 1, wherein the material is selected from the group consisting of fabrics, polymer fibers, textile fibers, polymer films, polymer sheets, and any combination thereof.

9. The personal protective equipment of claim 1, wherein the metal nanoparticle agglomerates are adhered to the material with an adhesive layer, wherein the nanoparticle agglomerates are partially embedded in the adhesive layer with a portion of the metal nanoparticle agglomerates exposed, wherein the adhesive layer slows down the production of oxidized metal species, thereby providing a time-release profile of active metal from the metal nanoparticle agglomerates.

10. The personal protective equipment of claim 1, wherein the personal protective equipment is self-sterilizing.

11. The personal protective equipment of claim 1, wherein the material comprises one or more touch surfaces and one or more non-touch surfaces, wherein the metal nanoparticle agglomerates are adhered to the one or more touch surfaces.

* * * * *